US007918311B2

(12) United States Patent
Matsueda et al.

(10) Patent No.: US 7,918,311 B2
(45) Date of Patent: Apr. 5, 2011

(54) MUFFLER AND ENGINE EXHAUST APPARATUS

(75) Inventors: Koji Matsueda, Toyota (JP); Tomoyuki Tsuji, Okazaki (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 146 days.

(21) Appl. No.: 12/376,874

(22) PCT Filed: Aug. 9, 2007

(86) PCT No.: PCT/JP2007/065926

§ 371 (c)(1),
(2), (4) Date: Feb. 9, 2009

(87) PCT Pub. No.: WO2008/018630

PCT Pub. Date: Feb. 14, 2008

(65) Prior Publication Data

US 2010/0126799 A1 May 27, 2010

(30) Foreign Application Priority Data

Aug. 11, 2006 (JP) ..... 2006-220726

(51) Int. Cl.
*F01N 1/08* (2006.01)
*F01N 1/02* (2006.01)

(52) U.S. Cl. ..... 181/275; 181/272; 181/251; 181/260

(58) Field of Classification Search ..... 181/275, 181/272, 268, 249, 251, 237, 257, 233, 234, 181/259, 260, 262
See application file for complete search history.

(56) References Cited

U.S. PATENT DOCUMENTS

| | | | | |
|---|---|---|---|---|
| 2,070,543 | A * | 2/1937 | Hollerith et al. | 181/266 |
| 2,235,705 | A | 3/1941 | Muffler | |
| 3,620,330 | A | 11/1971 | Hall | |
| 3,841,435 | A * | 10/1974 | Hetherington | 181/266 |
| 4,393,956 | A * | 7/1983 | Tsukui et al. | 181/265 |
| 4,574,913 | A * | 3/1986 | Fukuda | 181/231 |

(Continued)

FOREIGN PATENT DOCUMENTS

DE 35 06 150 8/1986

(Continued)

OTHER PUBLICATIONS

Office Action issued Sep. 15, 2010 in Chinese Application No. 200780029725.1 (With English Translation).

*Primary Examiner* — Edgardo San Martin
(74) *Attorney, Agent, or Firm* — Oblon, Spivak, McClelland, Maier & Neustadt, L.L.P.

(57) ABSTRACT

A muffling chamber is located between a first main body wall and a second main body wall with respect to a height direction. An outflow pipe includes: a first opening that connects an outflow passage with a muffling chamber in the vicinity of a first main body wall; and a second opening that connects the outflow passage with the muffling chamber in the vicinity of a second main body wall. The liquid staying on the first main body wall of a first muffler flows into the outflow passage through the first opening. The liquid staying on a second main body wall of a second muffler flows into the outflow passage through a second opening. Therefore, the symmetry of the first muffler and the second muffler is compatible with anti-corrosion.

28 Claims, 36 Drawing Sheets

U.S. PATENT DOCUMENTS

| | | | | | |
|---|---|---|---|---|---|
| 4,735,283 | A | | 4/1988 | Macaluso | |
| 4,909,347 | A | * | 3/1990 | Wang | 181/272 |
| 4,926,635 | A | | 5/1990 | Sakuma | |
| 5,014,817 | A | * | 5/1991 | Takato et al. | 181/254 |
| 5,542,707 | A | | 8/1996 | Kamei et al. | |
| 5,708,237 | A | * | 1/1998 | Maeda et al. | 181/254 |
| 5,739,483 | A | | 4/1998 | Yashiro et al. | |
| 5,984,045 | A | * | 11/1999 | Maeda et al. | 181/254 |
| 6,024,617 | A | * | 2/2000 | Smullin et al. | 440/89 R |
| 6,141,958 | A | * | 11/2000 | Voss | 60/272 |
| 6,173,808 | B1 | * | 1/2001 | Maeda et al. | 181/254 |
| 6,176,347 | B1 | * | 1/2001 | Chae et al. | 181/254 |
| 6,571,911 | B2 | * | 6/2003 | Watanabe et al. | 181/265 |
| 6,644,437 | B1 | * | 11/2003 | Hayman | 181/268 |
| 6,668,973 | B2 | * | 12/2003 | Grandmougin et al. | 181/272 |
| 7,282,185 | B2 | * | 10/2007 | Harris | 422/181 |
| 7,334,402 | B2 | * | 2/2008 | Hiraga | 60/312 |
| 7,503,427 | B2 | * | 3/2009 | Toyoshima | 181/272 |
| 7,571,789 | B2 | * | 8/2009 | Gilli | 181/251 |
| 7,712,578 | B2 | * | 5/2010 | Han | 181/272 |

FOREIGN PATENT DOCUMENTS

| | | | | |
|---|---|---|---|---|
| DE | 3526609 | A1 | * | 2/1987 |
| EP | 0 682 172 | | | 11/1995 |
| JP | 59-184315 | | | 12/1984 |
| JP | 63-147911 | | | 6/1988 |
| JP | 63-168210 | | | 11/1988 |
| JP | 63285213 | A | * | 11/1988 |
| JP | 8-48163 | | | 2/1996 |
| JP | 2000-179337 | | | 6/2000 |
| JP | 2005 69038 | | | 3/2005 |
| JP | 2005-140101 | | | 6/2005 |
| JP | 2005 330829 | | | 12/2005 |
| JP | 2005 330830 | | | 12/2005 |
| JP | 2006-2612 | | | 1/2006 |

* cited by examiner

MUFFLER AND ENGINE EXHAUST APPARATUS

FIELD OF THE INVENTION

The present invention relates to an engine exhaust apparatus, which includes a pair of mufflers arranged in the transverse direction of a vehicle.

BACKGROUND OF THE INVENTION

FIG. 36 shows a typical exhaust apparatus.

A V engine 100 has a first cylinder group 101 and a second cylinder group 102. An exhaust apparatus 110 is connected to the engine 100. The exhaust apparatus 110 is provided with: a pair of catalyst converters 120; a sub-muffler 130; a first muffler 140; and a second muffler 150.

The exhaust from the first cylinder group 101 reaches the sub-muffler 130 via a plurality of branch pipes 162 of a first exhaust manifold 160, a main pipe 161, a first front pipe 181, the right catalyst converter 120, a first branch pipe 183B of a first center pipe 183, and a main pipe 183A. The exhaust from the second cylinder group 102 flows into the sub-muffler 130 via a plurality of branch pipes 172 of a second exhaust manifold 170, a main pipe 171, a second front pipe 182, the left catalyst converter 120, a second branch pipe 183*c* of a first center pipe 183, and a main pipe 183A. The exhaust from the sub-muffler 130 flows into the first muffler 140 from a main pipe 184A of a second center pipe 184 via a first branch pipe 184B or flows into a second muffler 150 via a second branch pipe 184C. Japanese Laid-Open Patent Publication No. 2005-69038 shows an example of a first muffler 140 and a second muffler 150.

The first muffler 140 and the second muffler 150 arranged in the transverse direction of a vehicle is comparatively costly in the case where the mufflers 140, 150 have different structures.

SUMMARY OF THE INVENTION

It is an objective of the present invention to provide an improved muffler and an engine exhaust apparatus provided with the muffler.

According to one aspect of the present invention, an exhaust apparatus for an engine of a vehicle is provided. The exhaust apparatus is provided with: an exhaust pipe through which the exhaust from the engine flows; and a first muffler and a second muffler that are arranged transversely in a vehicle. The first muffler and the second muffler are connected to an exhaust pipe in a state in which the first and second mufflers are vertically inverted with respect to each other. The first muffler and the second muffler are each provided with a muffler main body which has a muffling chamber for muffling an exhaust gas, an inflow pipe for allowing the exhaust from the exhaust pipe to flow into a muffling chamber, and an outflow pipe for conducting the exhaust from the muffling chamber to the outside. The outflow pipe has an outflow outlet from which exhaust is discharged. The outflow outlet is located at the center in the height direction of the muffler main body.

Further, according to another aspect of the present invention, a muffler is provided. The muffler is provided with a muffler main body having a muffling chamber; an inflow pipe for allowing the exhaust from an exhaust pipe to flow into the muffling chamber; and an outflow pipe for conducting the exhaust from the muffling chamber to the outside. The muffler main body has a first main body wall and a second main body wall that are opposite to each other in a height direction while the muffling chamber is located therebetween. The outflow pipe has: a first opening that connects a passage of an outflow pipe with a muffling chamber in the vicinity of the first main body wall; and a second opening that connects a passage of an outflow pipe with the muffling chamber in the vicinity of the second main body wall. In the case where the muffler is at a reference posture, the first main body wall is located vertically downwardly of the second main body wall. Liquid staying on the first main body wall can flow into a passage of an outflow pipe from the first opening. In the case where the muffler is vertically inverted with respect to the reference posture, the liquid staying on the second main body wall can flow into a passage of an outflow pipe from the second opening.

BRIEF DESCRIPTION OF THE DRAWINGS

FIG. 33B is a projection view in a width direction, of the muffler of FIG. 33A;

DETAILED DESCRIPTION OF THE PREFERRED EMBODIMENTS

FIGS. 1 to 29 show a first embodiment of the present invention.

Figure 1:
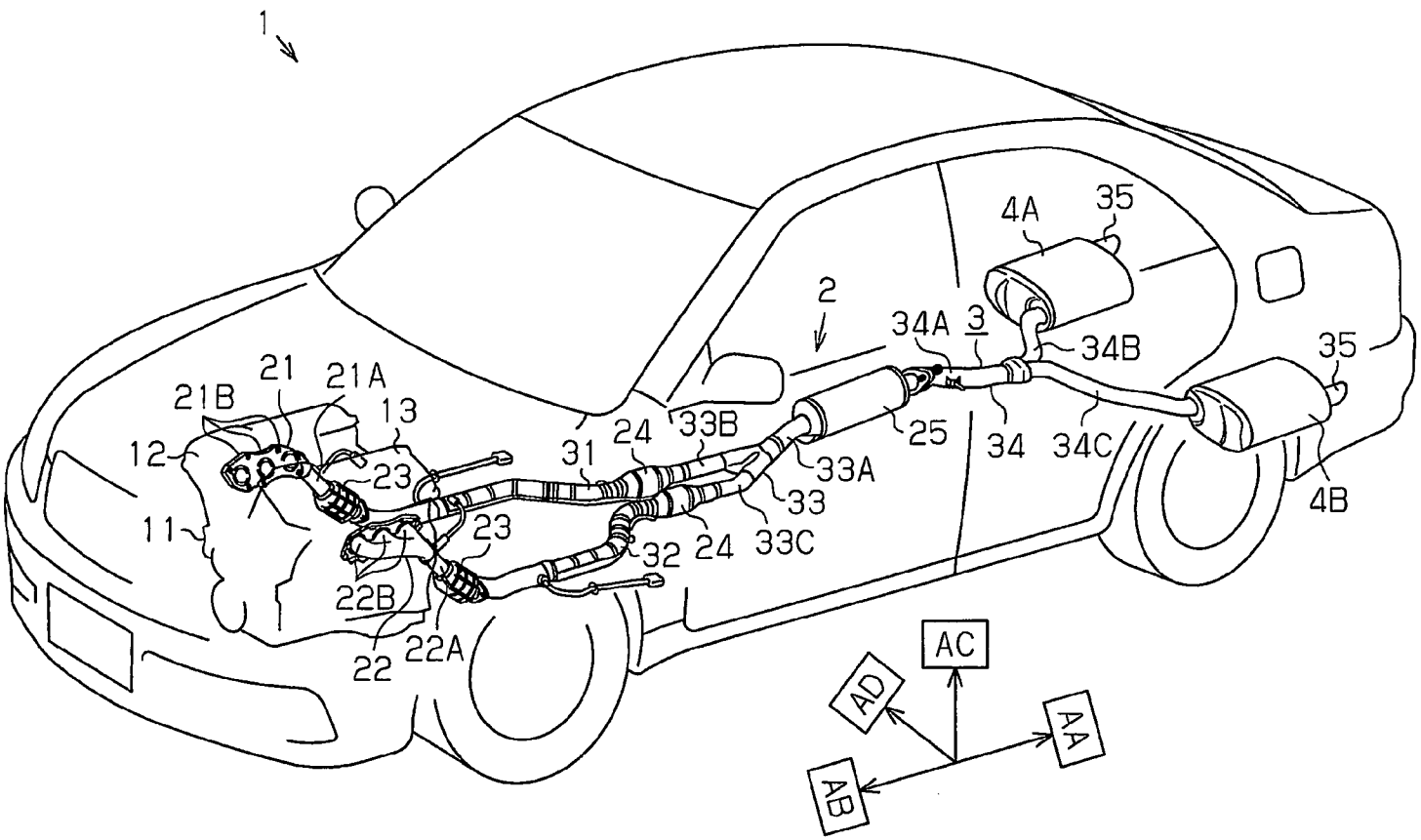
FIG. 1 is a perspective view of an engine exhaust apparatus according to a first embodiment of the present invention.
Figure 2:
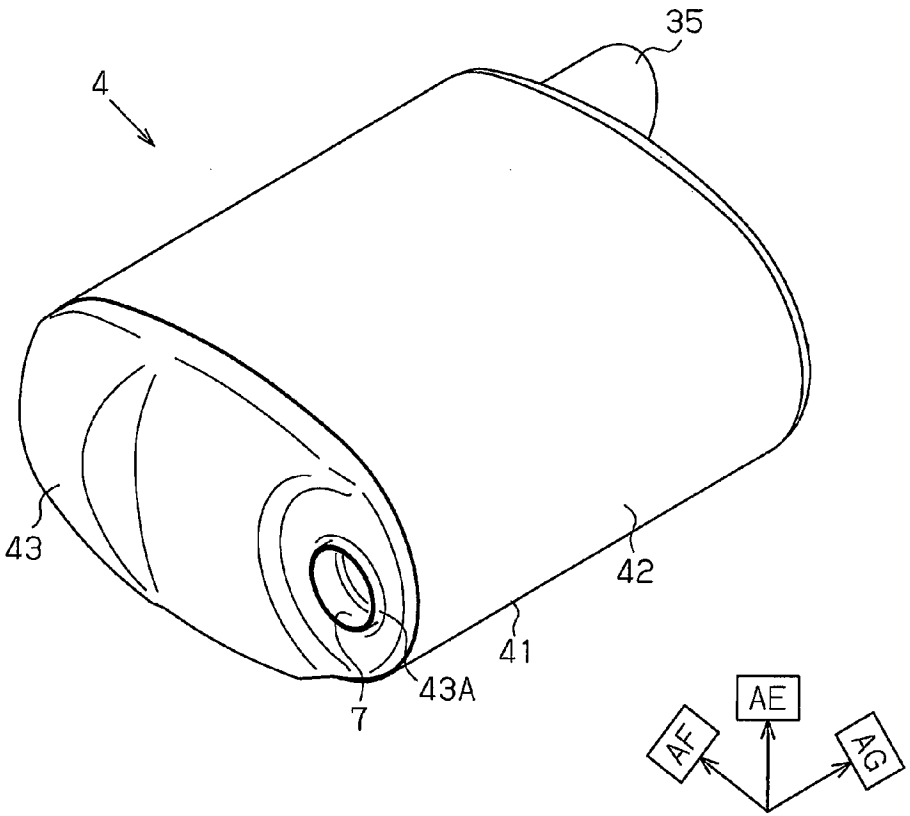
FIG. 2 is a perspective view of the muffler shown in FIG. 1.

FIG. 1 shows an exhaust system of the vehicle 1 according to the first embodiment. While a given position of the exhaust system is defined as a reference, a side toward an engine 11 from the reference is referred to as an upstream side, and a side toward an exhaust outlet from the reference is referred to as a downstream side. The direction oriented from the upstream side to the downstream side is referred to as exhaust forward direction AA, and the direction oriented from the downstream side to the upstream side is referred to as exhaust reverse direction AB. Forward direction AA denotes a direction oriented from the front side to the rear side of the vehicle 1, and the reverse direction AB denotes a direction oriented from the rear side to the front side of the vehicle 1. Assume that height direction AC of the vehicle 1 coincides with a height direction, and width direction AD of the vehicle 1 coincides with a horizontal direction.

The vehicle 1 is provided with the engine 11 and an exhaust apparatus 2. The arrangement of cylinders of the engine 11 is of V type. The exhaust apparatus 2 changes the state of exhaust produced from the engine 11 to a desirable state, and then, conducts the exhaust to the outside of the vehicle 1. The engine 11 is provided with a first cylinder group 12 and a second cylinder group 13. The first cylinder group 12 and the second cylinder group 13 each have a plurality of linearly arranged cylinders.

The exhaust apparatus 2 is provided with left and right first catalyst converters 23; left and right second catalyst converters 24; a sub-muffler 25; a first muffler 4A; and a second muffler 4B. The first catalyst converters 23 and the second catalyst converters 24 each purify harmful substances in exhaust. The sub-muffler 25 muffles exhaust at the downstream of the second catalyst converter 24. The first muffler 4A and the second muffler 4B each muffle exhaust at the downstream side of the sub-muffler 25.

Further, the exhaust apparatus 2 is provided with: a first exhaust manifold 21; a second exhaust manifold 22; and an exhaust pipe 3. The first exhaust manifold 21 is connected to an exhaust port of the first cylinder group 12. The second exhaust manifold 22 is connected to an exhaust port of the second cylinder group 13. An exhaust pipe 3 is connected to each of the members described above. The first exhaust manifold 21, the second exhaust manifold 22, and the exhaust pipe 3 permit the passage of the exhaust from the engine 11.

The first exhaust manifold 21 is provided with a main pipe 21A and a plurality of branch pipes 21B. The main pipe 21A is connected to an inlet of the first catalyst converter 23. The branch pipes 21B branch at the inlet of the main pipe 21A, and then, each of them is connected to an exhaust port of the first cylinder group 12 that corresponds thereto. The second exhaust manifold 22 is provided with a main pipe 22A and a plurality of branch pipes 228. The main pipe 22A is connected to an inlet of the first catalyst converter 23. The branch pipes 22B branch at the inlet side of the main pipe 22A, and then, each of them is connected to an exhaust port of the second cylinder group 13 that corresponds thereto.

The exhaust pipe 3 is provided with: a first front pipe 31; a second front pipe 32; a first center pipe 33; a second center pipe 34; and a pair of tail pipes 35. The first front pipe 31 connects an outlet of the right first catalyst converter 23 to an inlet of the right second catalyst converter 24 at the downstream side of the first exhaust manifold 21. The second front pipe 32 connects an outlet of the left first catalyst converter 23 to an inlet of the left second catalyst converter 24 at the downstream side of the second exhaust manifold 22. The first center pipe 33 connects an outlet of each of the second catalyst converters 24 to an inlet of the sub-muffler 25. The second center pipe 34 connects an outlet of the sub-muffler 25 to an inlet of the first muffler 4A and an inlet of the second muffler 4B. Each of the tail pipes 35 is connected to an outlet of each of the first and second mufflers 4A and 4B that correspond thereto.

The first center pipe 33 is provided with: a main pipe 33A; and a first branch pipe 33B and a second branch pipe 33C that branch at the inlet side of the main pipe 33A. The main pipe 33A is connected to an inlet of the sub-muffler 25. The first and second branch pipes 33B and 33C are each connected to an outlet of the second catalyst converter 24 that corresponds thereto. The length from a branch point of the main pipe 33A to an inlet of the first branch pipe 33B is equal to the length from a branch point of the main pipe 33A to an inlet of the second branch pipe 33C. The main pipe 33A is disposed at the center of the vehicle 1 with respect to width direction AD of the vehicle 1.

The second center pipe 34 is provided with: a main pipe 34A; and a first branch pipe 34B and a second branch pipe 34C that branch at the outlet side of the main pipe 34A. The main pipe 34A is connected to an outlet of the sub-muffler 25. The first branch pipe 34B is connected to an inlet of the first muffler 4A, and then, the second branch pipe 34C is connected to an inlet of the second muffler 4B. The length from a branch point of the main pipe 34A to an outlet of the first branch pipe 34B is equal to the length from a branch point of the main pipe 34A to an outlet of the second branch pipe 34C. The main pipe 34A is set at the center of the vehicle 1 with respect to width direction AD.

The exhaust from the first cylinder group 12 passes through the first exhaust manifold 21; the first catalyst converter 23; the first front pipe 31; the second catalyst converter 24; the first center pipe 33; and the sub-muffler 25 sequentially in order.

The exhaust from the second cylinder group 13 passes through the second exhaust manifold 22; the first catalyst converter 23; the second front pipe 32; the second catalyst converter 24; the first center pipe 33; and the sub-muffler 25 sequentially in order. The exhaust from the sub-muffler 25 passes through the first muffler 4A or the second muffler 4B via the second center pipe 34, and then, is discharged from the tail pipe 35 to the outside of the vehicle 1.

The first muffler 4A and the second muffler 4B are arranged in the transverse direction of the vehicle 1. In other words, the first muffler 4A and the second muffler 4B are disposed in parallel with respect to the fore-and-aft direction of the vehicle 1. The first muffler 4A and the second muffler 4B are each a main muffler. The first muffler 4A and the second muffler 4B each have the same structure. The first muffler 4A and the second muffler 4B are of inversion type, and each is connected to the exhaust pipe 3 in a posture that is respectively different. The second muffler 4B is vertically inverted with respect to the first muffler 4A. The posture of the first muffler 4A is referred to as a reference posture, and the posture of the second muffler 4B is referred to as an inverted posture.

FIGS. 2 to 6B show the first muffler 4A. Hereinafter, the first muffles 4A will be mainly described.

Figure 3:
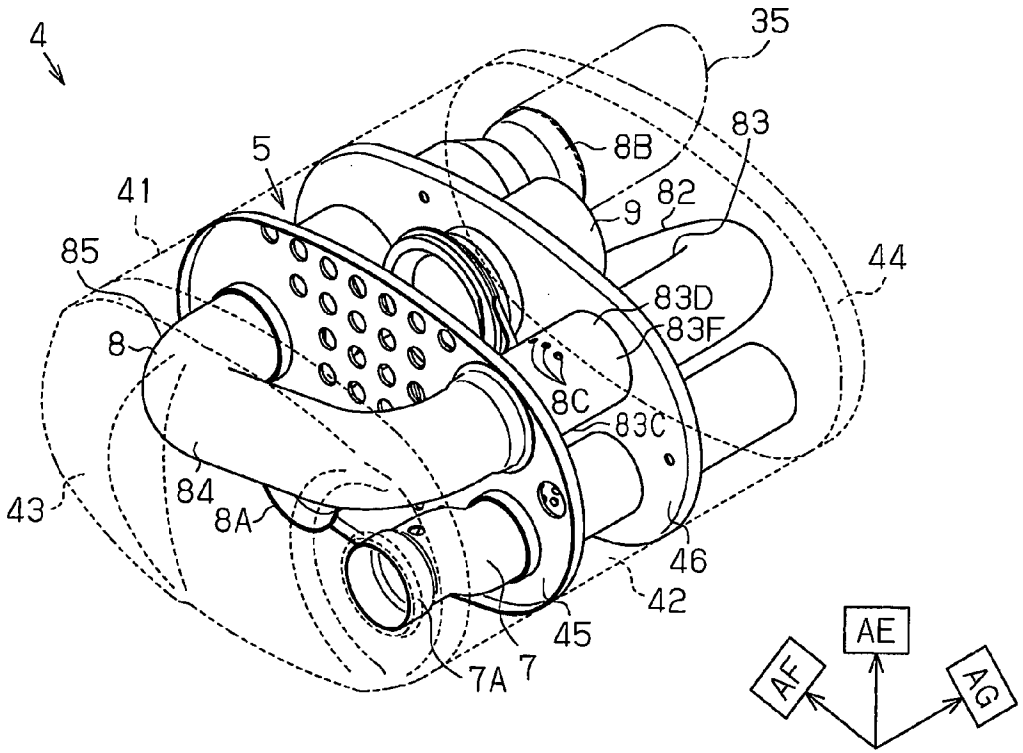
FIG. 3 is a perspective view of an inside of the muffler of FIG. 2.
Figure 4:
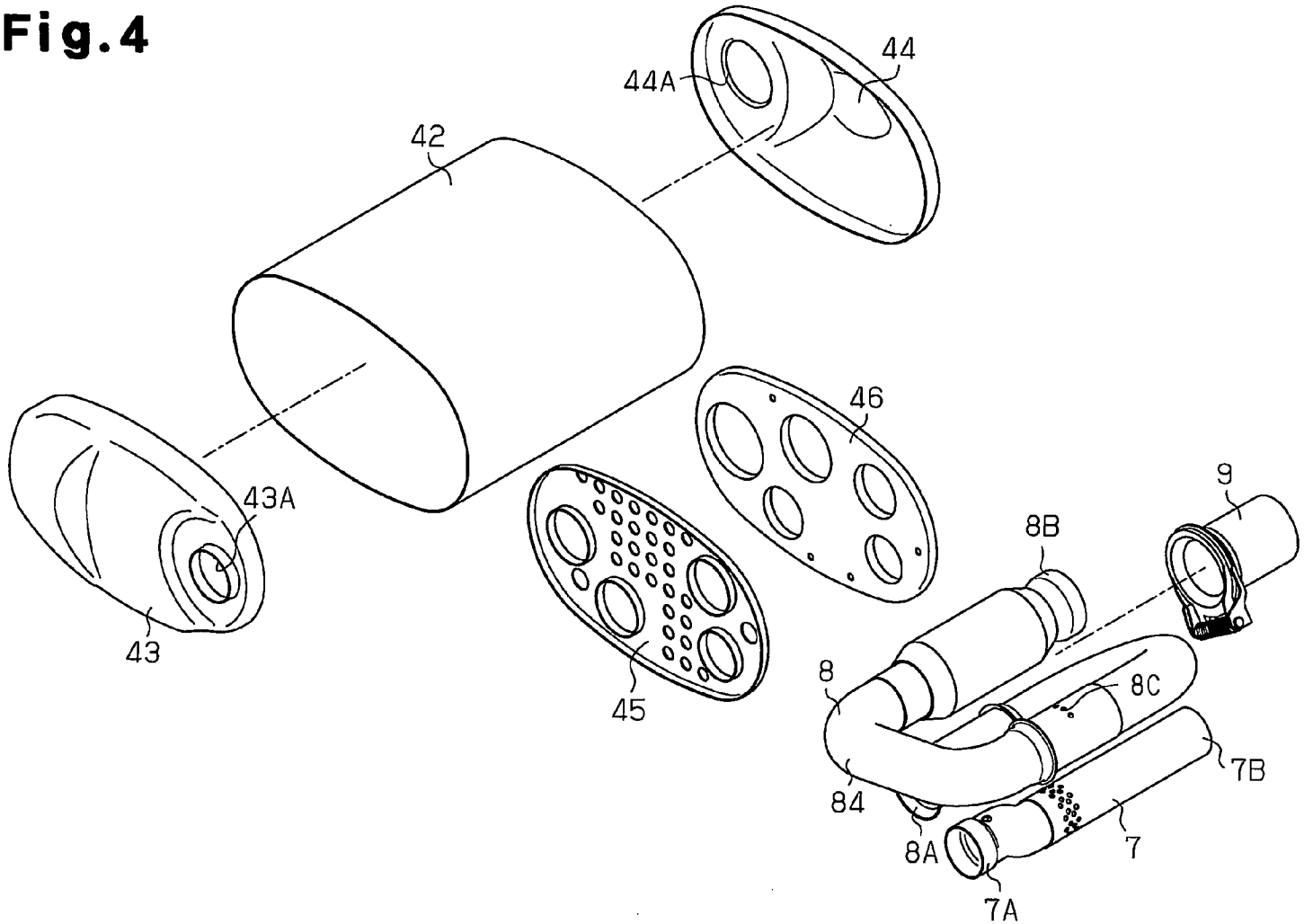
FIG. 4 is an exploded perspective view of the muffler of FIG. 2.

As shown in FIG. 3, the first muffler 4A is provided with: a muffler main body 41; an inflow pipe 7; an outflow pipe 8; and the inner pipe 9. The muffler main body 41 has a muffling chamber 5 for muffling exhaust. The inflow pipe 7 allows flow of the exhaust from the second center pipe 34 into the muffling chamber 5. The outflow pipe 8 feeds the exhaust muffled in the muffling chamber 5 to a tail pipe 35. The inner pipe 9 is disposed in the muffler main body 41.

In a state in which height direction AE of the first muffler 4A coincides with height direction AC of the vehicle 1 and width direction AF of the first muffler 4A coincides with width direction AD of the vehicle 1, the first muffler 4A is connected to the second center pipe 34. As shown in FIG. 3, longitudinal direction AG of the first muffler 4A is perpendicular to height direction AE and width direction AF.

The muffler main body 41 is provided with: an outer shell 42; a first external plate 43; a second external plate 44; a first separator 45; and a second separator 46. The flat cylindrical outer shell 42 has the muffling chamber 5 therein. The outer shell 42 has an upstream side first opening and a downstream side second opening. The first external plate 43 serving as a first exterior wall closes a first mouth of the outer shell 42. The second external plate 44 serving as a second exterior wall closes a second mouth of the outer shell 42. The first separator 45 and the second separator 46 partition the muffling chamber 5 into a first muffling chamber 51; a second muffling chamber 52; and a third muffling chamber 53.

The first external plate 43 has a main body inlet 43A serving as a first plate opening. The main body inlet 43A supports the inflow pipe 7 serving as an inflow exhaust pipe. The inflow pipe 7 has: an inflow inlet 7A positioned at a first end; and an inflow outlet 7B positioned at a second end. The inflow inlet 7A is joined with the main body inlet 43A.

The second external plate 44 has a main body outlet 44A serving as a second plate opening. The main body outlet 44A supports the outflow pipe 8 serving as an outflow exhaust pipe. The outflow pipe 8 has: an outflow inlet 8A positioned at a first end; and an outflow outlet 8B positioned at a second end. The outflow outlet 8B is joined with the main body outlet 44A.

Figure 5:
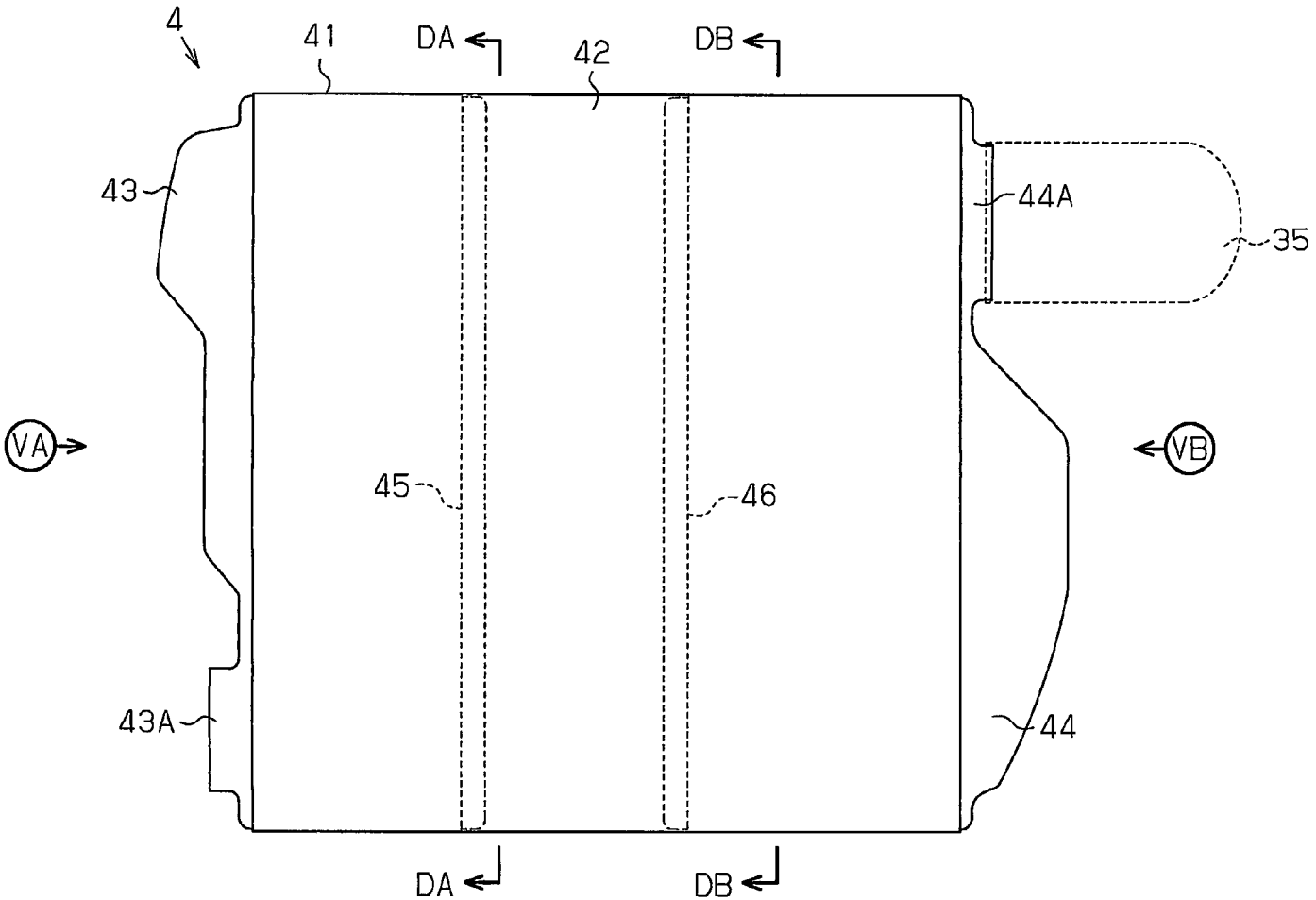
FIG. 5 is a plan view of the muffler of FIG. 2.
Figure 6A:
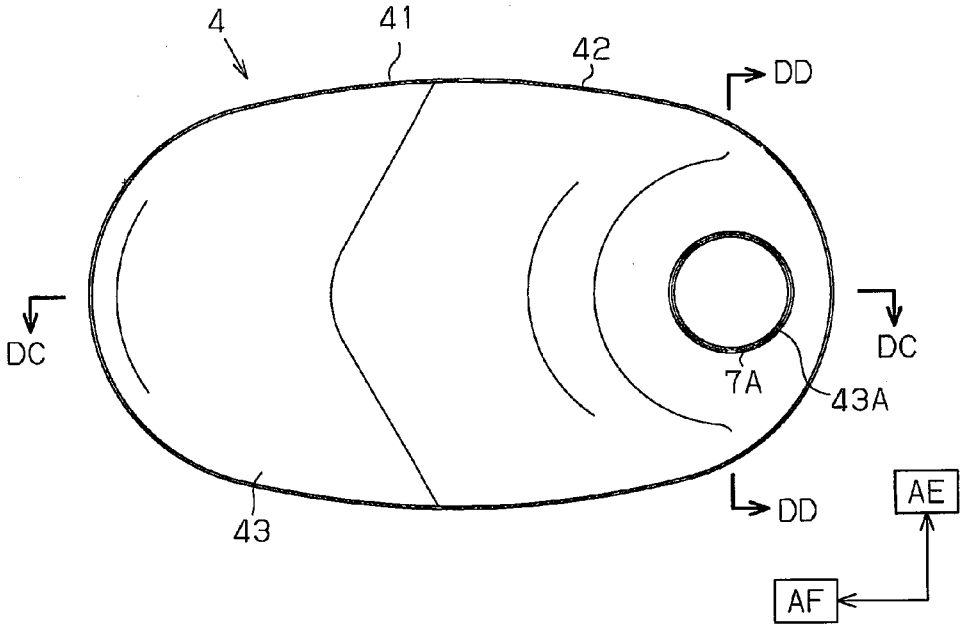
FIG. 6A is a front view of the muffler of FIG. 5 as seen in direction VA.
Figure 6B:
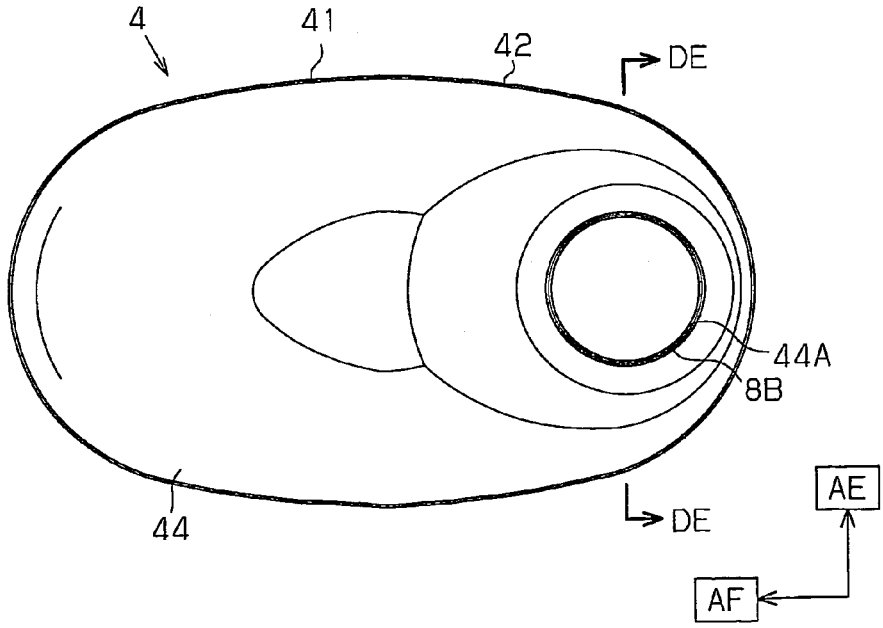
FIG. 6B is a rear view of the muffler of FIG. 5 as seen in direction VB.
Figure 7:
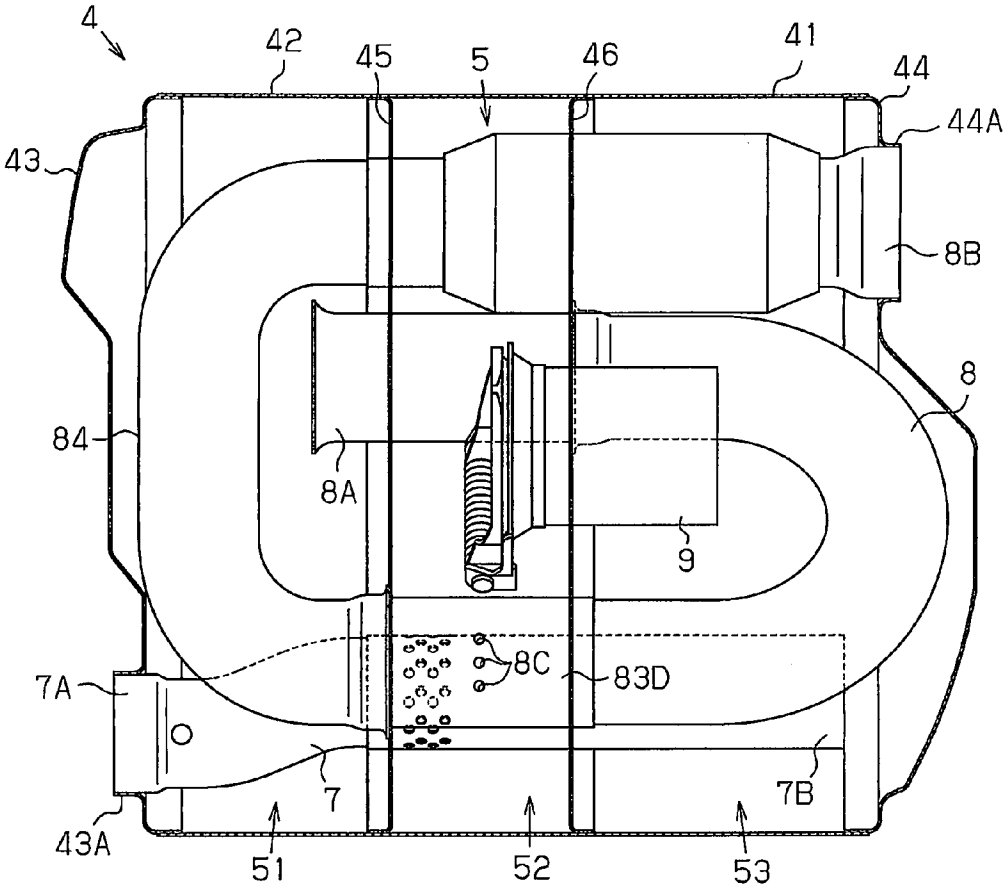
FIG. 7 is a transparent view taken along plane DC-DC of the muffler of FIG. 6A.
Figure 8A:
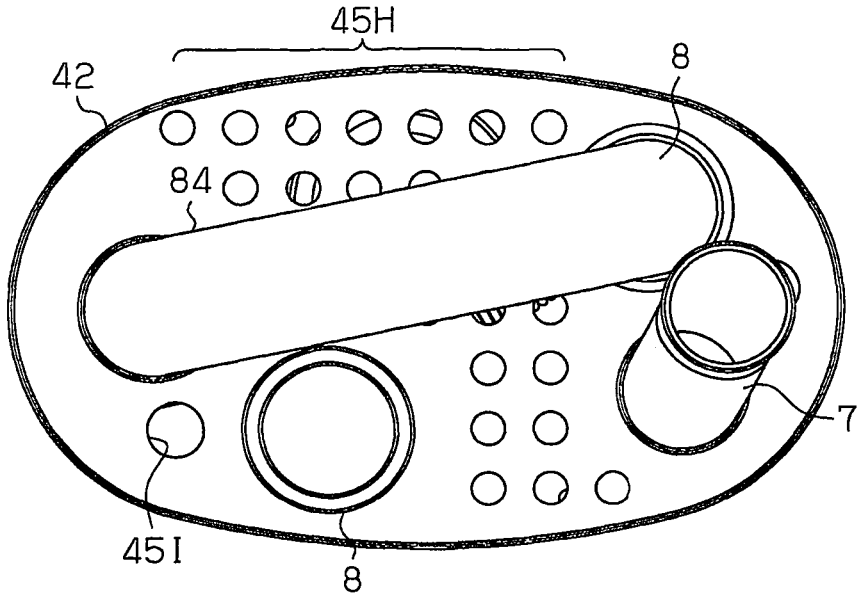
FIG. 8A is a front view of the muffler of FIG. 5 as seen in direction VA with a first external plate removed.
Figure 8B:
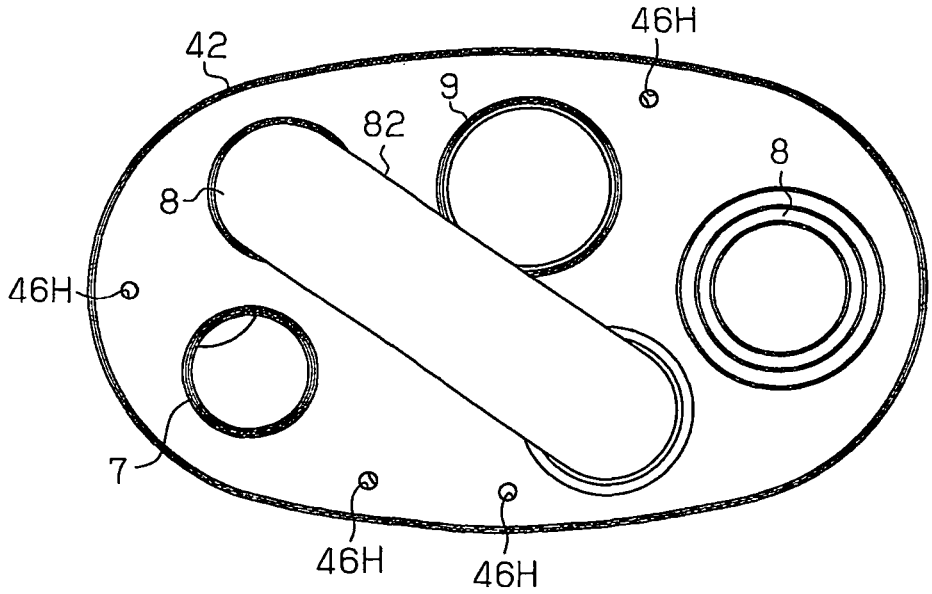
FIG. 8B is a rear view of the muffler of FIG. 5 as seen in direction VB with a second external plate removed.
Figure 9A:
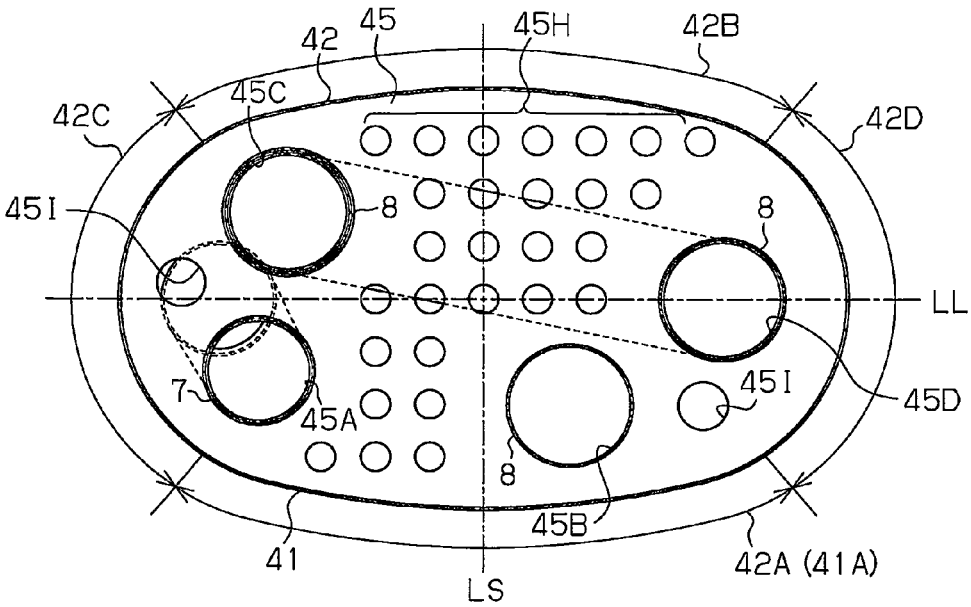
FIG. 9A is a cross-sectional view of the muffler taken along line DA-DA of FIG. 5.
Figure 9B:
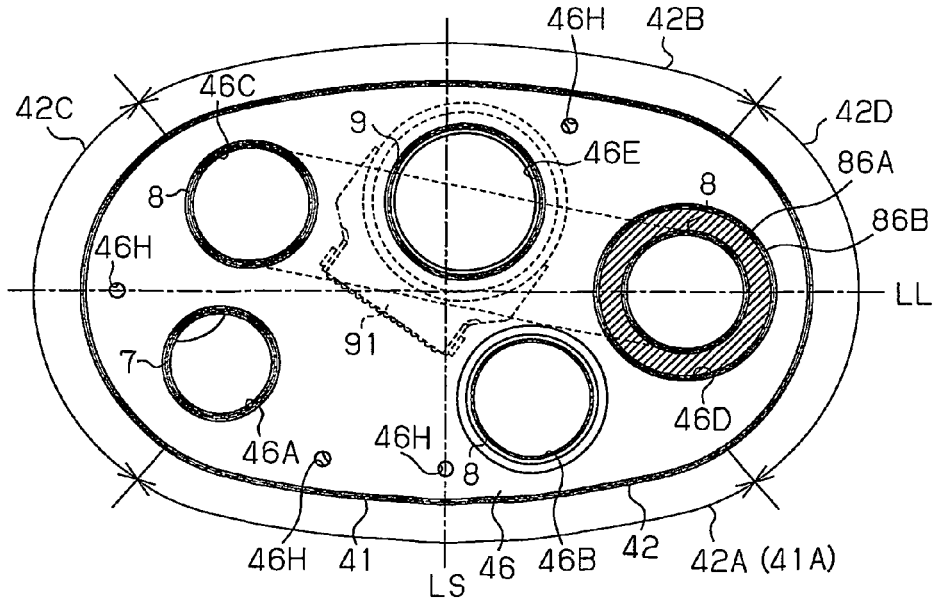
FIG. 9B is a cross-sectional view of the muffler taken along line DB-DB of FIG. 5.

FIGS. 7 to 9B show an inside of the first muffler 4A. FIG. 7 shows a plan view of the first muffler 4A when the outer shell 42, the first external plate 43, and an upper half of the second external plate 44 have been removed. FIG. 8A shows a front view of the first muffler 4A from which the first external plate 43 has been removed; and FIG. 8B shows a rear view of the first muffler 4A from which the second external plate 44 has been removed. FIG. 9A shows a cross-sectional view of the first muffler 4A taken along the line DA-DA of FIG. 5, and FIG. 9B shows a cross-sectional view of the first muffler 4A taken along the line DB-DB of FIG. 5.

As shown in FIG. 7, the outer shell 42, the first external plate 43, and the second external plate 44 define the muffling chamber 5. The muffling chamber 5 houses the first separator 45 and the second separator 46. The outer shell 42, the first external plate 43, and the first separator 45 define the first muffling chamber 51. The outer shell 42, the first separator 45, and the second separator 46 define the second muffling chamber 52. The outer shell 42, the second separator 46, and the second external plate 44 define the third muffling chamber 53.

As shown in FIG. 9A, the first separator 45 serving as a first interior wall has: a first support hole 45A; a second support hole 45B; a third support hole 45C; a fourth support hole 45D; a number of first through holes 45H; and two second through holes 45I. The peripheral rim of the first support hole 45A supports the inflow pipe 7. The peripheral rims of the second support hole 45B, third support hole 45C, and fourth support hole 45D support the outflow pipe 8. Each of the first through hole 45H and the second through hole 45I connects the first muffling chamber 51 with the second muffling chamber 52. In the range in which the strength of the first separator 45 is ensured, the number and the size of the first through holes 45H are increased to maximize the flow rate of exhaust flowing from the second muffling chamber 52 to the first muffling chamber 51. In FIG. 9A, the first support hole 45A is located at the lower left part of the first separator 45; the second support hole 45B is located at the lower right part thereof; the third support hole 45C is located at the upper left part thereof; and the fourth support hole 45D is located at the right center thereof. The second support hole 45B is located lower than the first support hole 45A, the third support hole 45C, and the fourth support hole 45D. A second through hole 45I is located between the first support hole 45A and the third support hole 45C, and the other second through hole 45I is located between the second support hole 45B and the fourth support hole 45D.

As shown in FIG. 9B, the second separator 46 serving as a second interior wall has: a fifth support hole 46A; a sixth support hole 46B; a seventh support hole 46C; an eighth support hole 46D; a ninth support hole 46E; and four third through holes 46H. The peripheral rim of the fifth support hole 46A supports the inflow pipe 7. The peripheral rims of the sixth support hole 46B, seventh support hole 46C, and eighth support hole 46D support the outflow pipe 8. The peripheral rim of the ninth support hole 46E supports the inner pipe 9. Each of the third through holes 46H connects the second muffling chamber 52 with the third muffling chamber 53. When a passage of the inner pipe 9 is closed, a small amount of exhaust flows from the third muffling chamber 53 to the second muffling chamber 52 through the third through hole 46H. In FIG. 9B, the fifth support hole 46A is located at the lower left part of the second separator 46; the sixth support hole 46B is located at the lower right part thereof; the seventh support hole 46C is located at the upper left part thereof; the eighth support hole 46D is located at the right center thereof; and the ninth support hole 46E is located at the upper center thereof. The sixth support hole 46B is located lower than the fifth support hole 46A, and the seventh support hole 46C to the ninth support hole 46E.

As shown in FIGS. 9A and 9B, a cross-section perpendicular to the fore-and-aft direction (AA) of the vehicle 1, of the outer shell 42, is formed in an elliptical shape. In other words, the cross-section of the outer shell 42 extending in width direction AF of the first muffler 4A is formed in an elliptical shape. A long axis LL of this ellipse extends in width direction AD of the vehicle 1. A short axis LS extends in height direction AC of the vehicle 1.

As shown in FIGS. 9A and 9B, the outer shell 42 is partitioned into a first main body wall 42A; a second main body wall 42B; a third main body wall 42C; and a fourth main body wall 42D, with respect to the circumferential direction. The first main body wall 42A, the second main body wall 42B, the third main body wall 42C, and the fourth main body wall 42D are a first peripheral wall part, a second peripheral wall part, a third peripheral wall part, and a fourth peripheral wall part, of the outer shell 42, respectively. The first main body wall 42A and the second main body wall 42B are opposite to each other while the muffling chamber 5 is located therebetween, in height direction AE of the first muffler 4A. The third main body wall 42C and the fourth main body wall 42D each connect the first main body wall 42A to the second main body wall 42B. The third main body wall 42C and the fourth main body wall 42D are opposite to each other while the muffling chamber 5 is located therebetween, in width direction AF of the first muffler 4A. The first main body wall 42A and the second main body wall 42B are opposite to each other while a long axis LL is located therebetween. The third main body wall 42C and the fourth main body 42D are opposite to each other while a short axis LS is located therebetween.

Figure 28A:
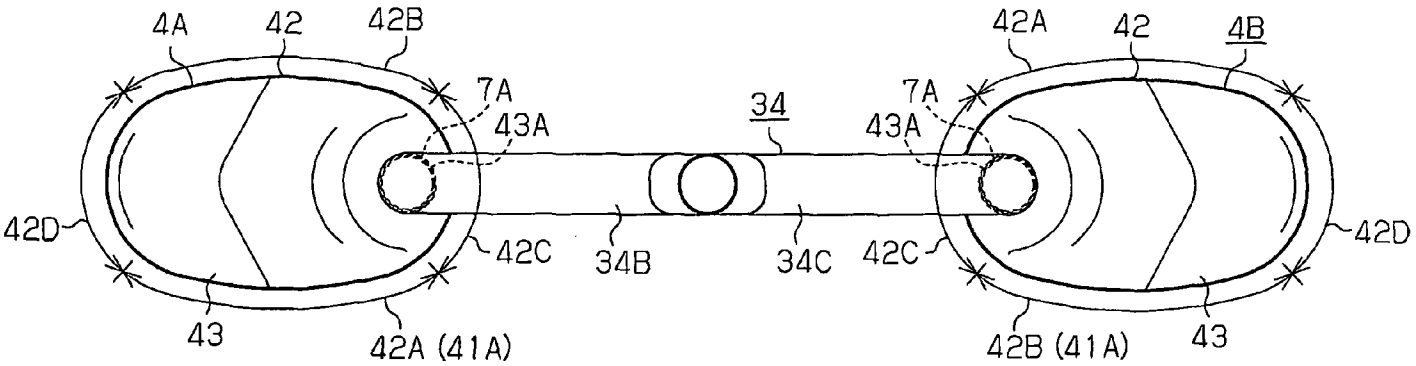
FIG. 28A is a plan view of the exhaust apparatus of FIG. 27 as seen in direction VN.
Figure 28B:
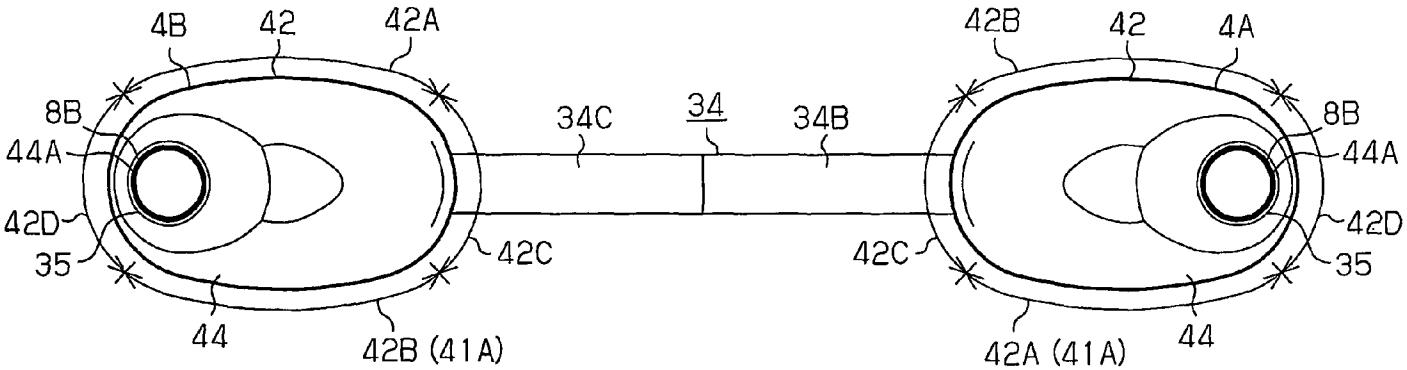
FIG. 28B is a rear view of the exhaust apparatus of FIG. 27 as seen in direction VO.

As shown in FIGS. 28A and 28B, the first main body wall 42A of the first muffler 4A is vertically lower than the second main body wall 42B of the first muffler 4A. In contrast, the first main body wall 42A of the second muffler 4B is vertically upper than the second main body wall 42B of the second muffler 4B. A bottom part 41A of the first muffler 4A is the first main body wall 42A. A bottom part 41A of the second muffler 4B is the second main body wall 42B.

As shown in FIGS. 28A and 28B, the third main body wall 42C of the first muffler 4A is located close to the center in width direction AD of the vehicle 1, and the fourth main body wall 42D of the first muffler 4A is located close to the side face of the vehicle 1. The third main body wall 42C of the second muffler 4B is located close to the center in width direction AD of the vehicle 1, and the fourth main body wall 42D of the second muffler 4B is located close to the side face of the vehicle 1.

As shown in FIGS. 10 to 12B, the inflow pipe 7 has an inflow exhaust passage 7R that extends from the inflow inlet 7A to the inflow outlet 7B. The inflow pipe 7 includes a first inflow pipe 71 and a second inflow pipe 72. The second inflow pipe 72 is connected to an outlet of the first inflow pipe 71 in series. The first branch pipe 34B or the second branch pipe 34C is connected to the inflow inlet 7A. The inflow outlet 7B is disposed in the third muffling chamber 53.

A first end of the first inflow pipe 71 is referred to as a first inflow inlet 71A.

A second end of the first inflow pipe 71 is referred to as a first inflow outlet 71B.

A first end of the second inflow pipe 72 is referred to as a second inflow inlet 72A.

A second end of the second inflow pipe 72 is referred to as a second inflow outlet 72B.

The first inflow inlet 71A is the inflow inlet 7A, and the second inflow outlet 72B is the inflow outlet 7B.

Figure 11A:
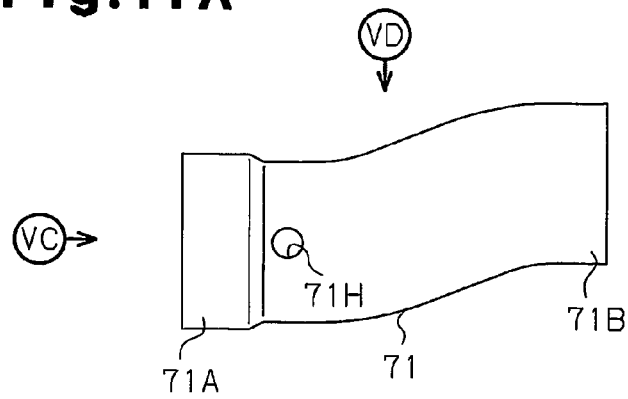
FIG. 11A is a plan view of the first inflow pipe shown in FIG. 10.
Figure 11B:
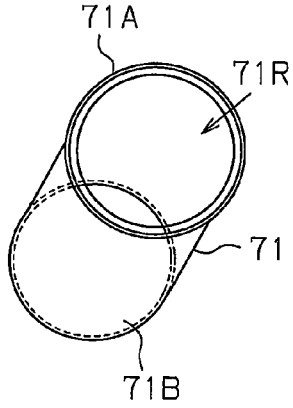
FIG. 11B is a front view of the first inflow pipe of FIG. 11A as seen in direction VC.

As shown in FIG. 11, the first inflow pipe 71 has a first inflow passage 71R that extends from the first inflow inlet 71A to the first inflow outlet 71B. The first inflow passage 71R extends in longitudinal direction AG with respect to the muffler main body 41. The peripheral rim of the first support hole 45A of the first separator 45 supports the first inflow outlet 71B. A plurality of fourth through holes 71H each connect the first inflow passage 71R with the first muffling chamber 51.

Figure 11C:
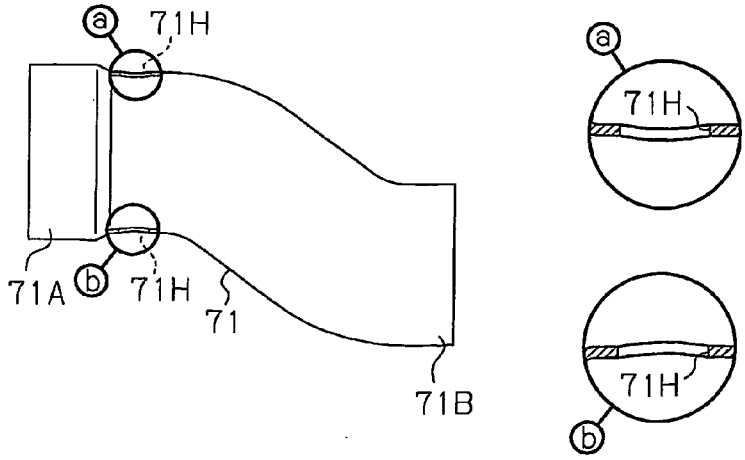
FIG. 11C is a side view of the first inflow pipe of FIG. 11A as seen in direction VD.

As shown in FIGS. 11A and 11C, the first inflow pipe 71 has a pair of fourth through holes 71H. The pair of fourth through holes 71H are located so as to oppose to each other while the first inflow passage 71R is located therebetween, in height direction AE. As shown in FIG. 9A, the first inflow inlet 71A is located at the center of the muffler main body 41, with respect to height direction AE. The first inflow outlet 71B is located in the vicinity of the center of the muffler main body 41 and in place close to the first main body wall 42A rather than the center, with respect to height direction AE. In other words, the first inflow pipe 71 is bent between the first inflow inlet 71A and the first inflow outlet 71B. The first inflow pipe 71 is located in the vicinity of the third main body wall 42C with respect to width direction AF of the muffler main body 41.

Figure 12A:
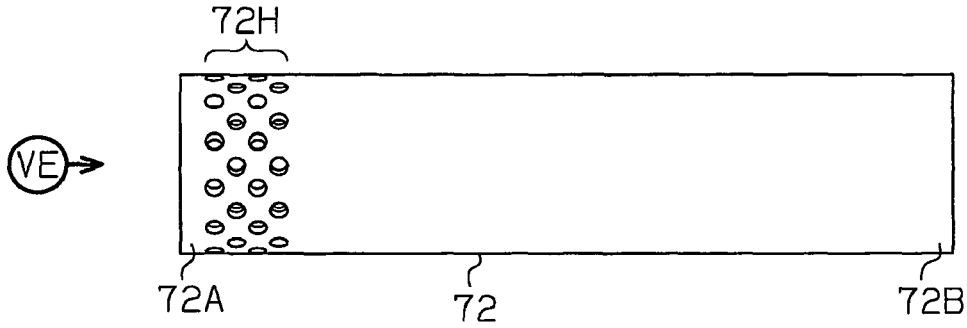
FIG. 12A is a plan view of the second inflow pipe shown in FIG. 10.
Figure 12B:
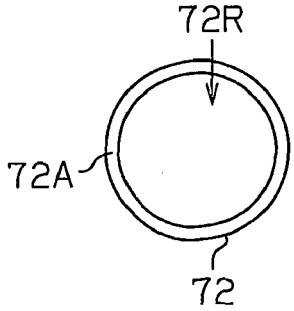
FIG. 12B is a front view of the second inflow pipe of FIG. 12A as seen in direction VE.

As shown in FIG. 12B, the second inflow pipe 72 has a second inflow passage 72R for distributing exhaust from the second inflow inlet 72A to the second inflow outlet 72B. The second inflow pipe 72 extends straight in longitudinal direction AG with respect to the muffler main body 41. As shown in FIG. 7, the first support hole 45A of the first separator 45 supports the second inflow inlet 72A. A fifth support hole 46A of the second separator 46 supports a portion of the second inflow pipe 72 between the second inflow inlet 72A and the second inflow outlet 72B. The second inflow outlet 72B is disposed in the third muffling chamber 53. The second inflow pipe 72 has a number of fifth through holes 72H that connect the second inflow passage 72R with the second muffling chamber 52. The fifth through holes 72H distribute in the circumferential direction at a portion of the second inflow pipe 72 located in the second muffling chamber 52. As shown in FIG. 9A, the second inflow pipe 72 is located in the vicinity of the center of the muffler main body 41 and in place close to the first main body wall 42A rather than the center, with respect to height direction AE. The second inflow pipe 72 is located in the vicinity of the third main body wall 42C with respect to width direction AF.

Figure 10:
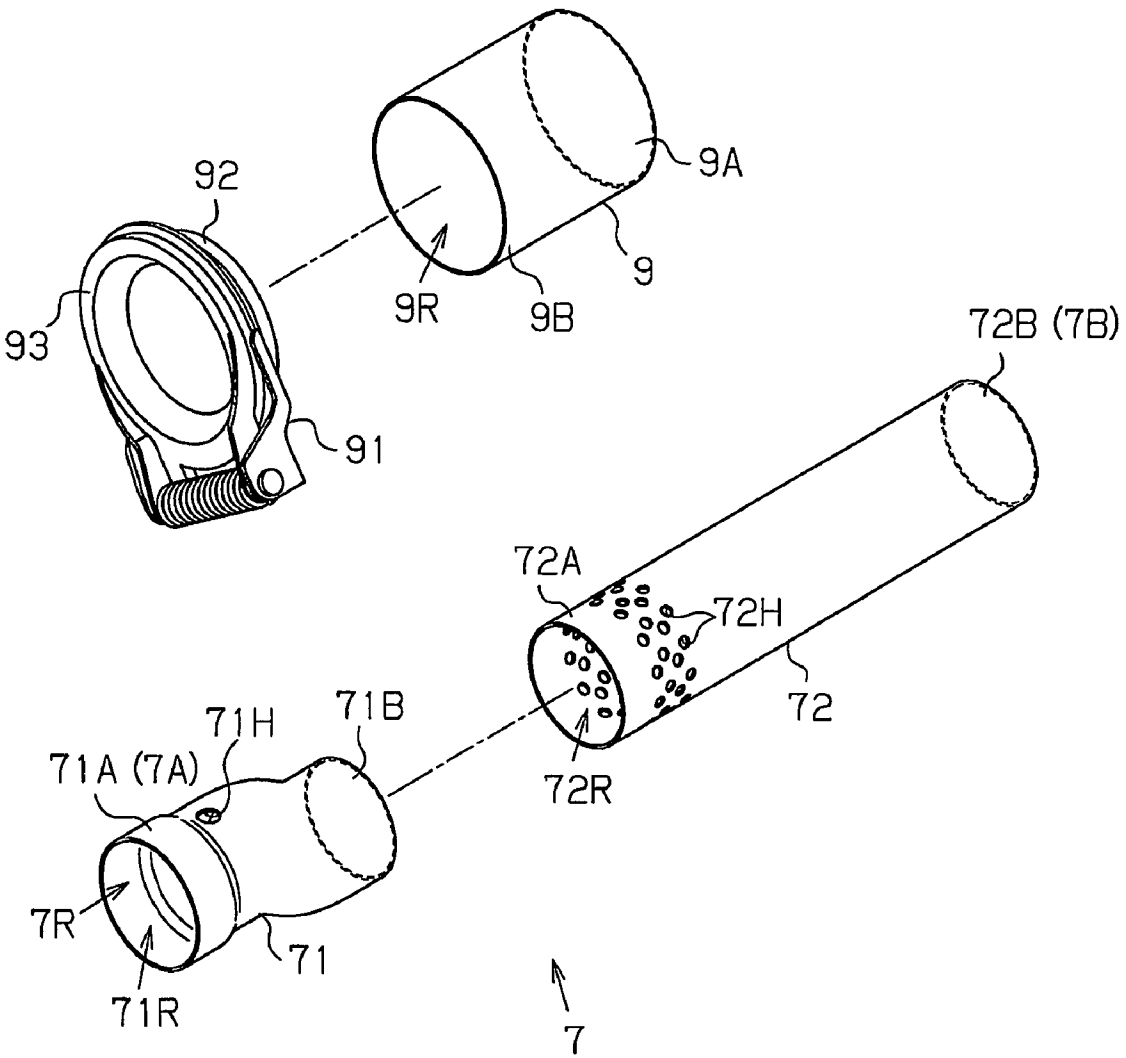
FIG. 10 is an exploded perspective view of the inflow pipe and the inner pipe shown in FIG. 4.

As shown in FIGS. 10 and 13, the inner pipe 9 has an inner passage 9R that allows the passage of exhaust from an inner inlet 9A to an inner outlet 9B. The inner pipe 9 extends straight in longitudinal direction AG with respect to the muffler main body 41. As shown in FIG. 7, the inner inlet 9A is disposed in the third muffling chamber 53. The inner outlet 9B is disposed in the second muffling chamber 52. A valve device 91 for opening and closing the inner passage 9R is mounted on the inner outlet 9B. The peripheral rim of the ninth support hole 46E of the second separator 46 supports the inner outlet 9B. As shown in FIG. 9B, the inner pipe 9 is located close to the second main body wall 42B in the vicinity of the center of the muffler main body 41 with respect to height direction AE, and is located close to the fourth main body wall 42D in the vicinity of the center of the muffler main body 41 with respect to width direction AF.

Figure 13A:
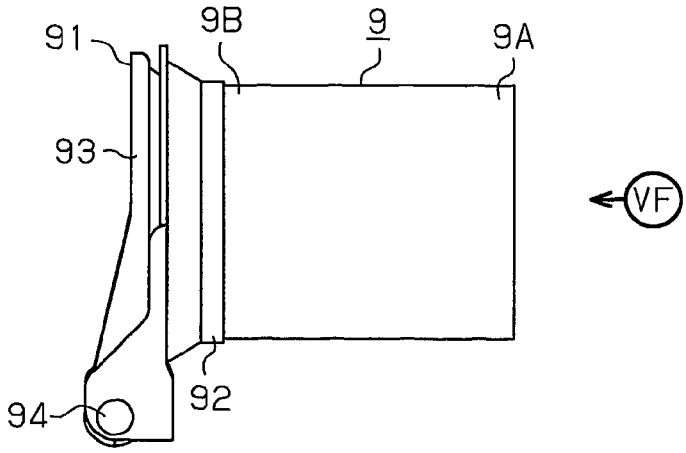
FIG. 13A is a plan view of the inner pipe shown in FIG. 10.
Figure 13B:
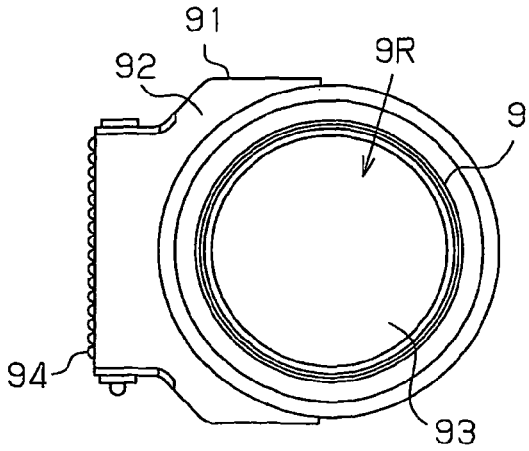
FIG. 13B is a rear view of the inner pipe of FIG. 13A as seen in direction VF.
Figure 14:
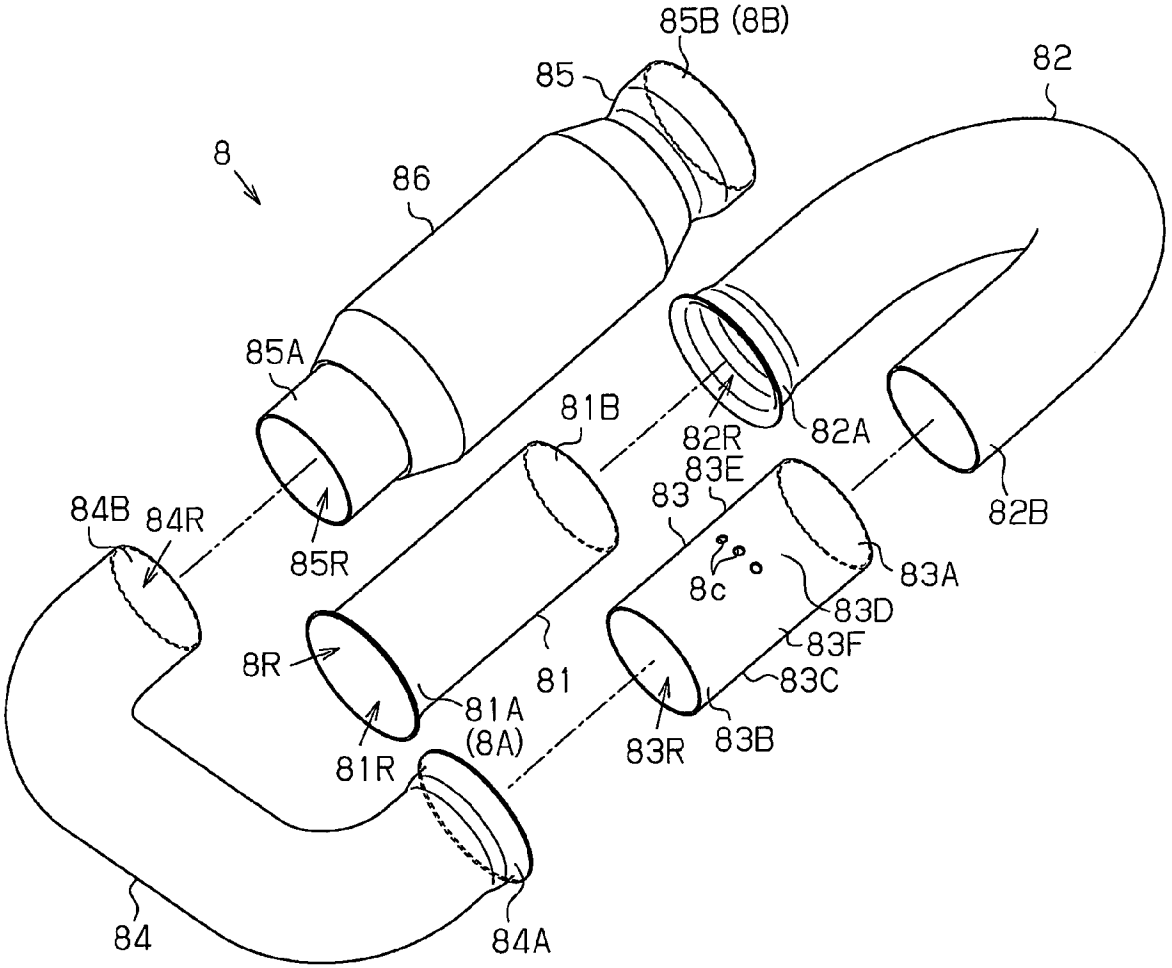
FIG. 14 is an exploded perspective view of the outflow pipe shown in FIG. 4.

As shown in FIGS. 13A and 13B, the valve device 91 is provided with: a device main body 92; a valve body 93; and a return spring 94. The device main body 92 is mounted on the inner outlet 9B. The valve body 93 is provided in the device main body 92, and opens and closes the inner passage 9R. The return spring 94 urges the valve body 93 toward the closed direction. When the engine 11 stops, the valve body 93 is maintained in a closed state. When the valve device 91 is closed, the inner passage 9R is also closed. When the pressure of the third muffling chamber 53 is equal to or greater than a threshold value, the valve device 91 is maintained in an open state. When the valve device 91 is opened, the inner passage 9R is also opened. The valve device 91 is closed when the engine 11 rotates at a low speed, and is opened when the engine 11 rotates at a high speed.

As shown in FIGS. 14 to 20, the outflow pipe 8 has an outflow passage 8R that allows passage of exhaust from the outflow inlet 8A to the outflow outlet 8B. The outflow pipe 8 has: a first outflow pipe 81; a second outflow pipe 82; a third outflow pipe 83; a fourth outflow pipe 84; and a fifth outflow pipe 85 that are connected in series. A high frequency reduction device 86 for reducing exhaust noise with high frequency is provided at the periphery of the fifth outflow pipe 85.

A first end of the first outflow pipe 81 is referred to as a first outflow inlet 81A.

A second end of the first outflow pipe 81 is referred to as a first outflow outlet 81B.

A first end of the second outflow pipe 82 is referred to as a second outflow inlet 82A.

A second end of the second outflow pipe 82 is referred to as a second outflow outlet 82B.

A first end of the third outflow pipe 83 is referred to as a third outflow inlet 83A.

A second end of the third outflow pipe 83 is referred to as a third outflow outlet 83B.

A first end of the fourth outflow pipe 84 is referred to as a fourth outflow inlet 84A.

A second end of the fourth outflow pipe 84 is referred to as a fourth outflow outlet 84B.

A first end of the fifth outflow pipe 85 is referred to as a fifth outflow inlet 85A.

A second end of the fifth outflow pipe 85 is referred to as a fifth outflow outlet 85B.

The outflow inlet 8A serving as an outflow pipe inlet is identical to the first outflow inlet 81A. The outflow outlet 8B serving as an outflow pipe outlet is identical to the fifth outflow outlet 85B.

Figure 15A:
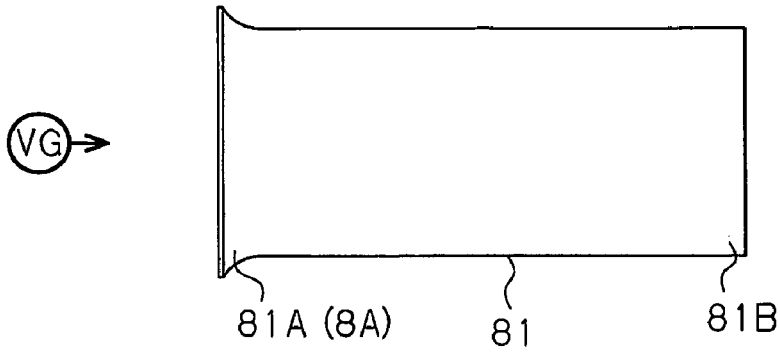
FIG. 15A is a plan view of the first outflow pipe shown in FIG. 14.
Figure 15B:
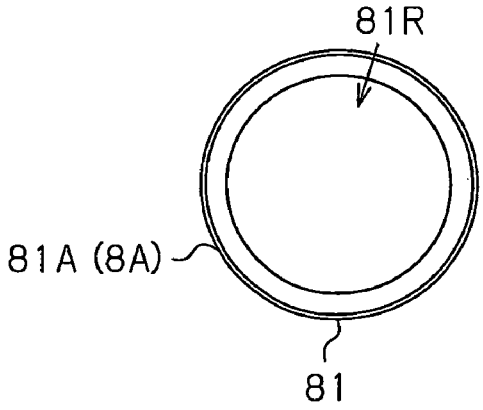
FIG. 15B is a front view of the first outflow pipe of FIG. 15A as seen direction VG.

As shown in FIGS. 15A and 15B, the first outflow pipe 81 has a first outflow passage 81R that allows passage of exhaust from the first outflow inlet 81A to the first outflow outlet 81B. The first outflow pipe 81 extends straight in longitudinal direction AG with respect to the muffler main body 41. As shown in FIG. 7, the first outflow inlet 81A is disposed in the first muffling chamber 51. The outflow inlet 8A is a first opening that connects the first outflow passage 81R with the muffling chamber 5 in the vicinity of the first main body wall 42A. The second support hole 45B of the first separator 45 supports a portion of the first outflow pipe 81 between the first outflow inlet 81A and the first outflow outlet 81B. A sixth support hole 46B of the second separator 46 supports the first outflow outlet 81B. The first outflow pipe 81 is located in the vicinity of the first main body wall 42A with respect to height direction AE, and is located close to the fourth main body wall 42D in the vicinity of the center of the muffler main body 41 with respect to width direction AF.

Figure 16A:
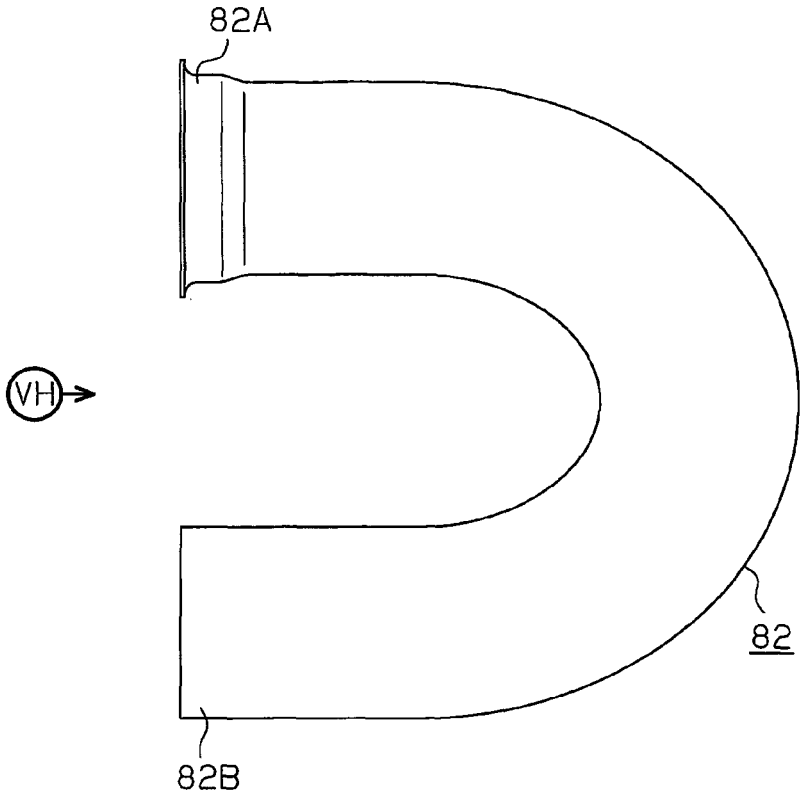
FIG. 16A is a plan view of the second outflow pipe shown in FIG. 14.
Figure 16B:
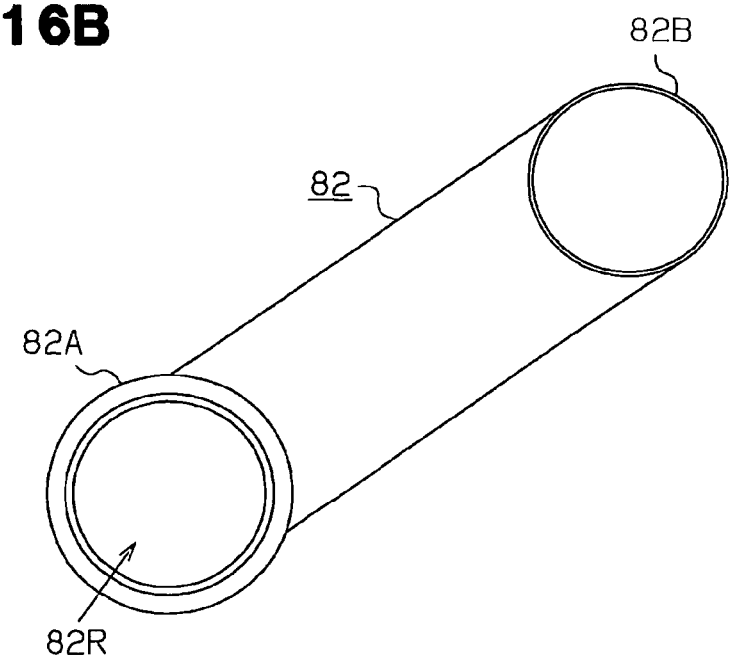
FIG. 16B is a plan view of the second outflow pipe of FIG. 16A as seen in direction VH.

As shown in FIGS. 16A and 16B, the second outflow pipe 82 has a second outflow passage 82R that allows passage of exhaust from the second outflow inlet 82A to the second outflow outlet 82B. The second outflow pipe 82 is formed in a U shape. As shown in FIGS. 9A and 9B, the exhaust flow of the second outflow pipe 82 changes from forward direction AA to reverse direction AB from the second outflow inlet 82A to the second outflow outlet 82B. The second outflow inlet 82A is joined with the second separator 46. The seventh support hole 46C of the second separator 46 supports the second outflow outlet 82B. As the second outflow pipe 82 runs from the second outflow inlet 82A to the second outflow outlet 82B, the pipe runs from the vicinity of the first main body wall 42A to the vicinity of the second main body wall 42B with respect to height direction AE, and runs from the vicinity of the center of the muffler main body 41 to the vicinity of the third main body wall 42C with respect to width direction AF.

Figure 17A:
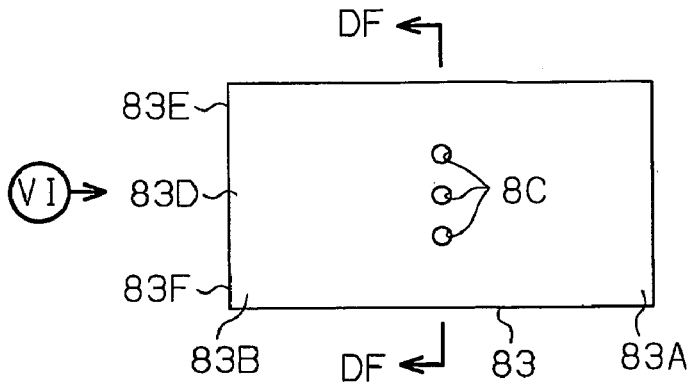
FIG. 17A is a plan view of the third outflow pipe shown in FIG. 14.
Figure 17B:
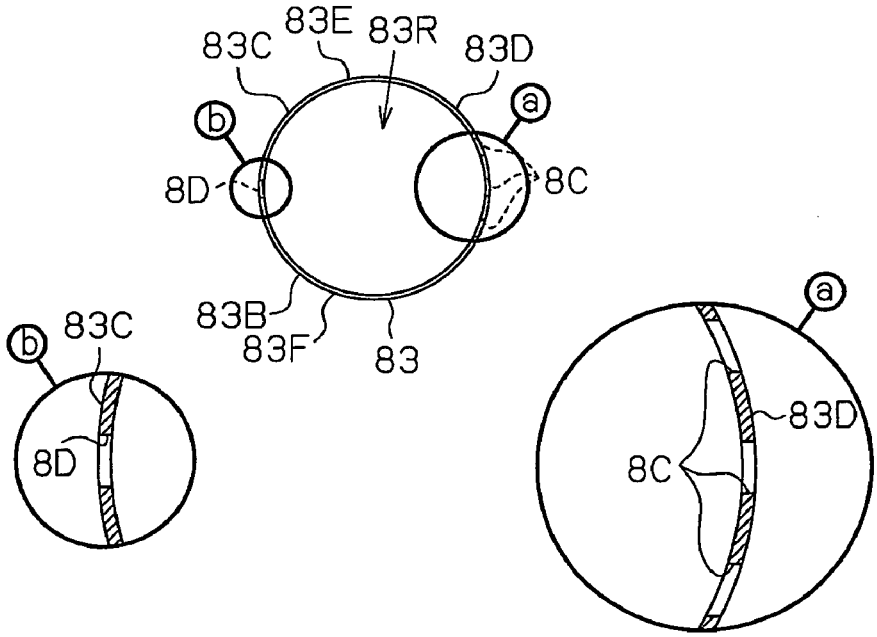
FIG. 17B is a front view and an enlarged view of the third outflow pipe of FIG. 17A, when turned at 90 degrees around an axis as seen in direction VI.

As shown in FIGS. 17A and 17B, the third outflow pipe 83 serving as an outflow intermediate portion has a third outflow passage 83R that allows passage of exhaust from the third outflow inlet 83A to the third outflow outlet 83B. The third outflow pipe 83 extends straight in longitudinal direction AG. The third outflow pipe 83 has three drainage holes 8C and a sixth through hole 8D. The drainage holes 8C and the sixth through hole 8D are opposite to each other while the third outflow passage 83R is located therebetween. Each of the drainage holes 8C is a second opening that connects the third outflow passage 83R with the muffling chamber 5 in the vicinity of the second main body wall 42B. In other words, the outflow inlet 8A of the first muffler 4A is adjacent to the first main body wall 42A serving as a bottom part of the first muffler 4A and the drainage holes 8C of the first muffler 4A are adjacent to the second main body wall 42B serving as a top part of the first muffler 4A. In contrast, the drainage holes 8C of the second muffler 4B are adjacent to the second main body wall 42B serving as a bottom part of the second muffler 4B and the outflow inlet 8A of the second muffler 4B is adjacent to the first main body wall 42A serving as a top part of the second muffler 4B. Condensed water 54 of the second muffler 4B stays at a bottom part 41A of the second muffler 4B, i.e., on the second main body wall 42B; passes through the drainage hole 8C; and then, flows into the outflow pipe 8. The sixth through hole 8D connects the first inflow passage 71R with the second muffling chamber 52. As shown in FIG. 9B, the peripheral rim of the seventh support hole 46C of the second separator 46 supports the third outflow inlet 83A. As shown in FIG. 9A, the peripheral rim of the third support hole 45C of the first separator 45 supports the third outflow outlet 83B. The third outflow pipe 83 is located in the vicinity of the second main body wall 42B with respect to height direction AE, and is located in the vicinity of the third main body wall 42C with respect to width direction AF.

Figure 18A:
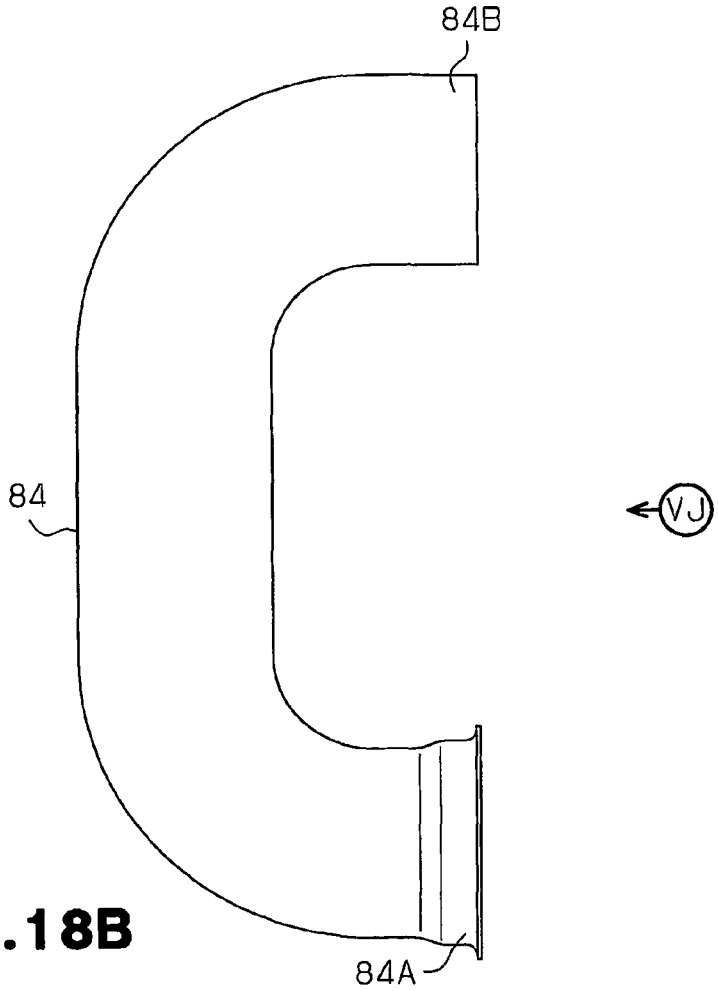
FIG. 18A is a plan view of the fourth outflow pipe shown in FIG. 14.
Figure 18B:
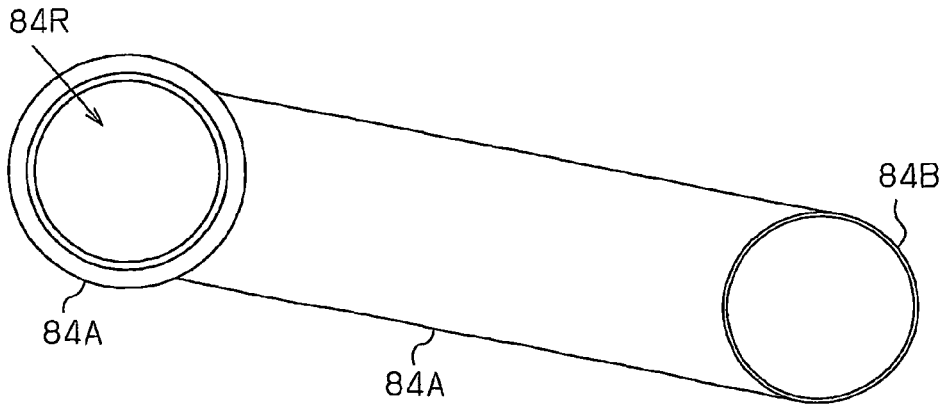
FIG. 18B is a rear view of the fourth outflow pipe of FIG. 18A as seen in direction VJ.

As shown in FIGS. 18A and 18B, the fourth outflow pipe 84 has a fourth outflow passage 84R that allows passage of exhaust from the fourth outflow inlet 84A to the fourth outflow outlet 84B. The fourth outflow pipe 84 is formed in a U shape. The exhaust flow of the fourth outflow pipe 84 changes from reverse direction AB to forward direction AA. As shown in FIG. 7, the fourth outflow inlet 84A is joined with the first separator 45 at the peripheral rim of the third support hole 45C. The peripheral rim of the fourth support hole 45D of the first separator 45 supports the fourth outflow outlet 84B. As shown in FIGS. 9A and 9B, as the fourth outflow pipe 84 runs from the fourth outflow inlet 84A to the fourth outflow outlet 84B, the pipe runs from the vicinity of the second main body wall 42B to the center of the muffler main body 41 with respect to height direction AE, and runs from the vicinity of the third main body wall 42C to the vicinity of the fourth main body wall 42D with respect to width direction AF.

Figure 19A:
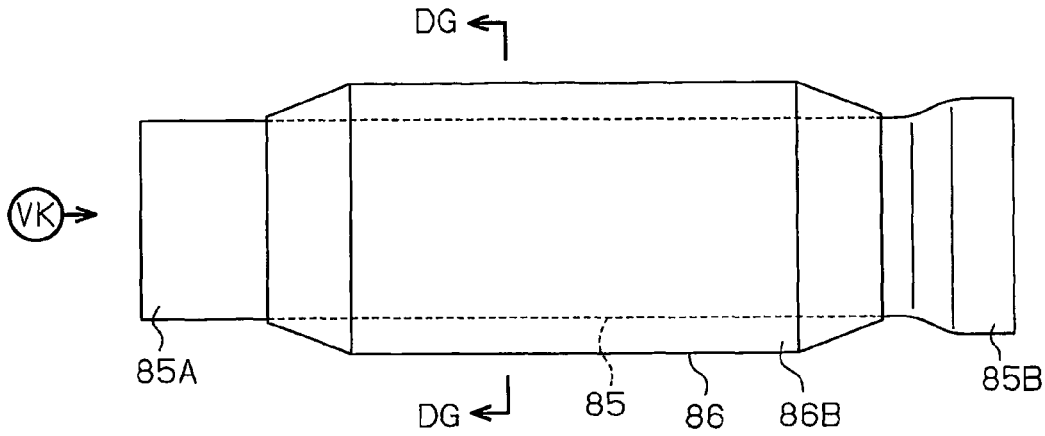
FIG. 19A is a plan view of the fifth outflow pipe and the high frequency reduction device shown in FIG. 14.
Figure 19B:
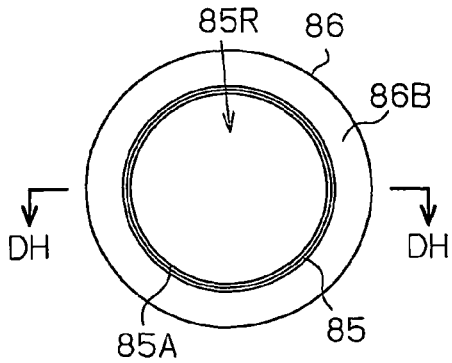
FIG. 19B is a front view of the fifth outflow pipe and the high frequency reduction device of FIG. 19A as seen in direction VK.

As shown in FIGS. 19A and 19B, the fifth outflow pipe 85 has a fifth outflow passage 85R that allows passage of exhaust from the fifth Outflow inlet 85A to the fifth outflow outlet 85B. The fifth outflow pipe 85 extends straight in longitudinal direction AG. As shown in FIG. 9B, the peripheral rim of the fourth support hole 45D of the first separator 45 supports the high frequency reduction device 86, thereby indirectly supporting the fifth outflow inlet 85A. The fifth outflow outlet 85B is joined with the peripheral rim of the main body outlet 44A. The fifth outflow pipe 85 is located at the center of the muffler main body 41 with respect to height direction AE, and is located in the vicinity of the fourth main body wall 42D with respect to width direction AF.

Figure 20A:
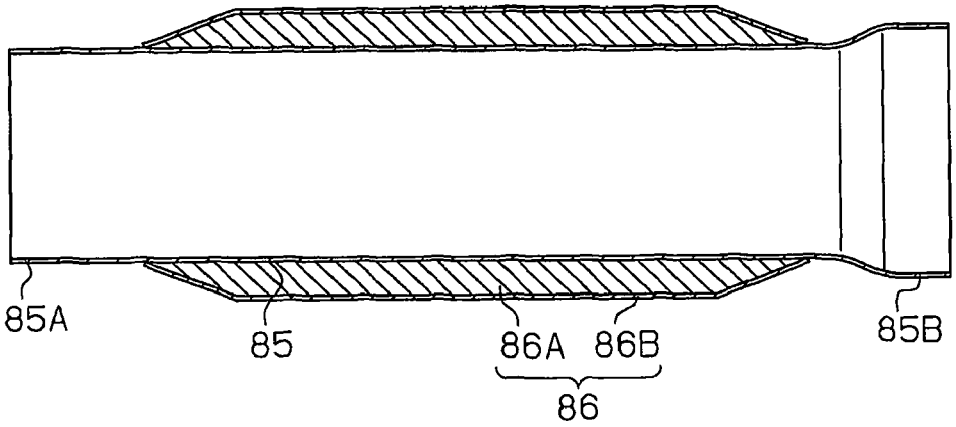
FIG. 20A is a cross-sectional view taken along line DH-DH of FIG. 19B.
Figure 20B:
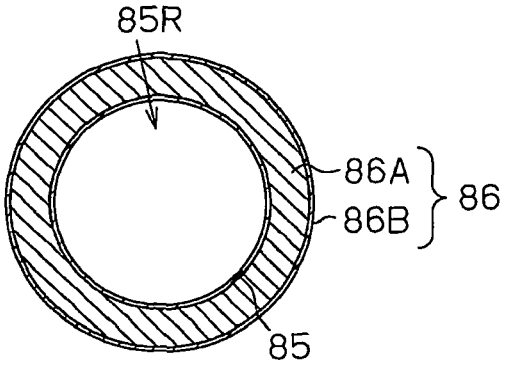
FIG. 20B is a cross-sectional view taken along line DG-DG of FIG. 19A.

As shown in FIGS. 20A and 20B, the high frequency reduction device 86 has a glass wool 86A and a cover 86B that covers the glass wool 86A. The glass wool 86A surrounds the fifth outflow pipe 85 in the circumferential direction. The exhaust noise with high frequency is reduced by the noise passing through the glass wool 86A. The glass wool 86A is located between an inner circumferential surface of the cover 86B and an outer circumferential surface of the fifth outflow pipe 85.

FIGS. 21 to 23B show the positions of openings of the inflow pipe 7, the outflow pipe 8, the first external plate 43, and the second external plate 44, respectively, with respect to the muffler main body 41.

Figure 21:
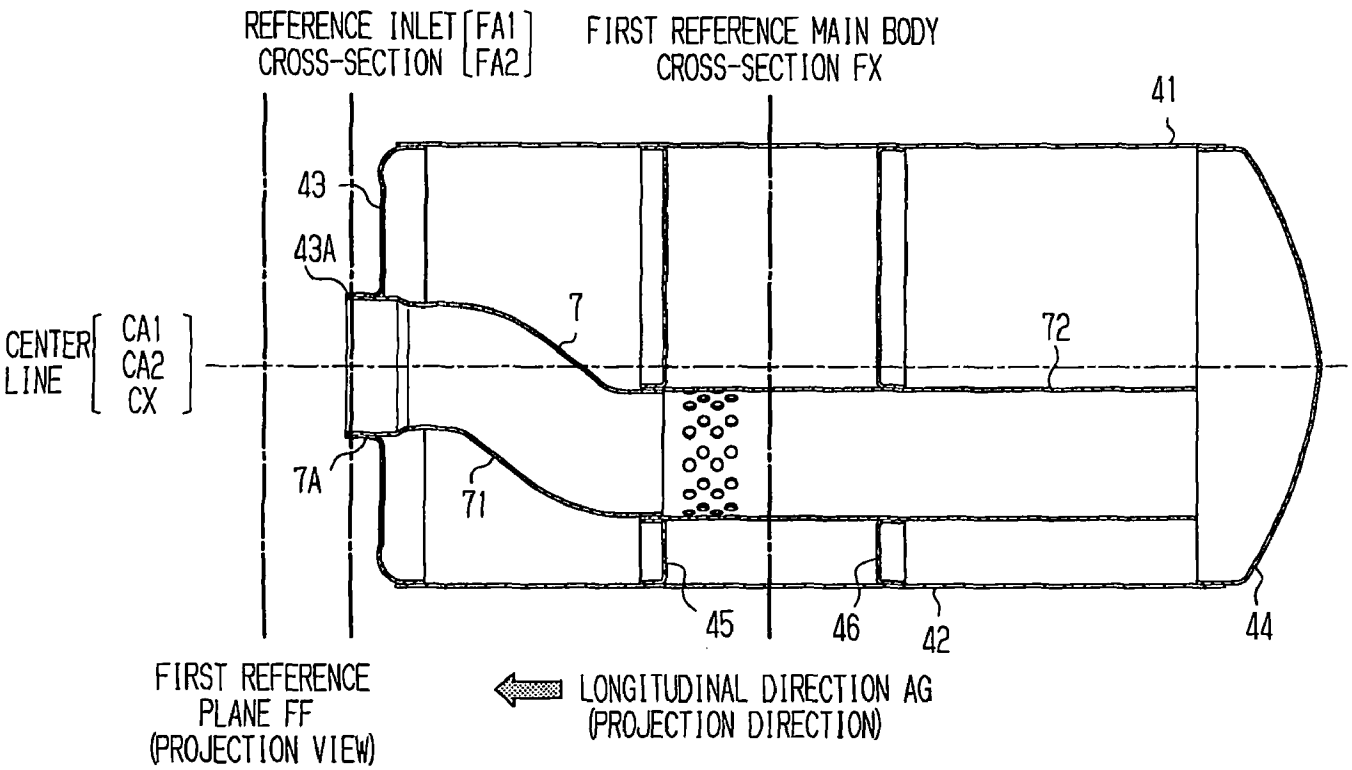
FIG. 21 is a cross-sectional view of the muffler taken along line DD-DD of FIG. 6A.
Figure 22:
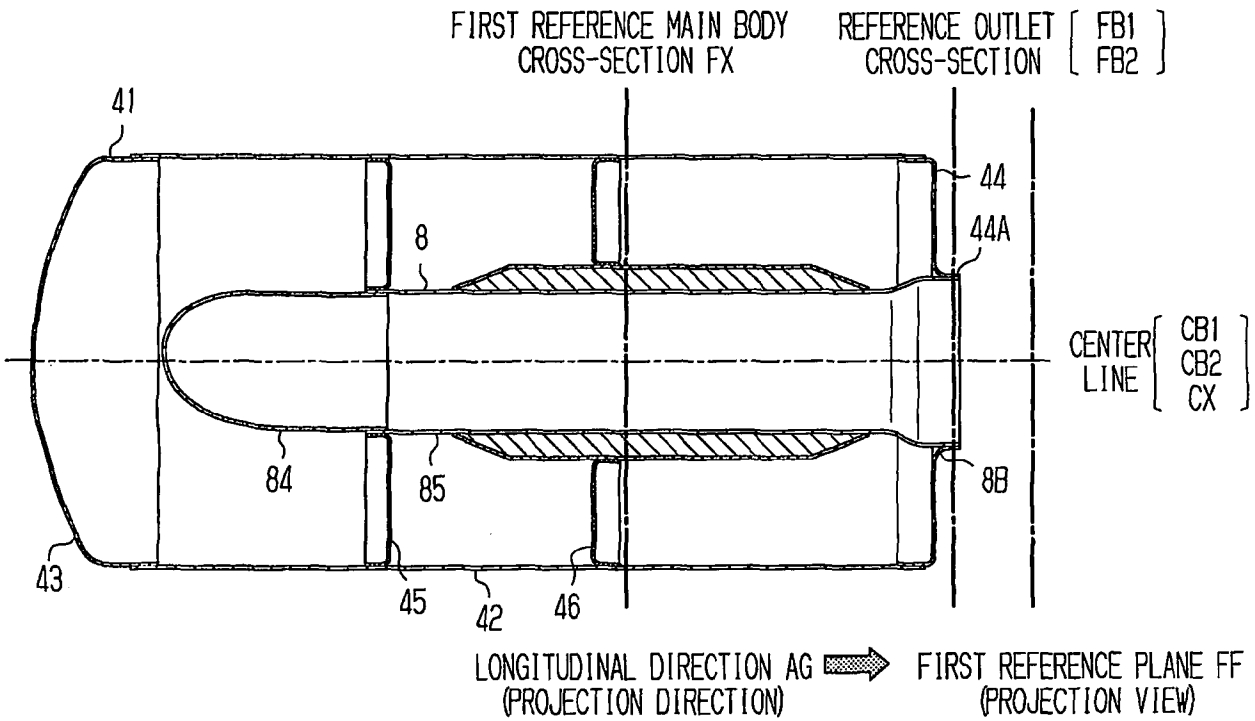
FIG. 22 is a cross-sectional view of the muffler taken along line DE-DE of FIG. 6B.

As shown in FIGS. 21 and 22, an imaginary plane perpendicular to longitudinal direction AG of the muffler main body 41 is referred to as a first reference plane FF. In other words, the first reference plane FF extends along width direction AF. A first shell body projection view ZX serving as a first main body projection view shown in FIG. 23 can be obtained by projecting the outer shell 42 onto the first reference plane FF. The projection direction of the first reference plane FF to the outer shell 42 is longitudinal direction AG of the first muffler 4A. The first inlet projection view ZA1 can be obtained by projecting the inflow inlet 7A to the first reference plane FF.

As shown in FIGS. 21 and 22, a cross-section perpendicular to the center line CX of the outer shell 42 is referred to as first reference main body cross-section FX. The first shell body projection view ZX can also be obtained by projecting onto the first reference plane FF the shape of the outer shell 42 in the first reference main body cross-section FX. A cross-section perpendicular to center line CA1 of the inflow inlet 7A is referred to as the first reference inlet cross-section FA1. The first inlet projection view ZA1 can also be obtained by projecting onto the first reference plane FF the shape of the inflow inlet 7A in the first reference inlet cross-section FA1.

As shown in FIG. 23, the inflow inlet 7A is disposed at the muffler main body 41 so that the center PA1 of the first inlet projection view ZA1 is located on the center line LX in height direction AE of the first shell body projection view ZX.

The main body inlet 43A is located at the center of the muffler main body 41 with respect to height direction AE. A second inlet projection view ZA2 shown in FIG. 23A can be obtained by projecting the main body inlet 43A onto the first reference plane FF. As shown in FIG. 21, the imaginary cross-section perpendicular to the center line CA2 of the main body inlet 43A is referred to as a second reference inlet cross-section FA2. The second inlet projection view ZA2 shown in FIG. 23A can be obtained by projecting onto the first reference plane FF the shape of the main body inlet 43A in the second reference inlet cross-section FA2.

Figure 23A:
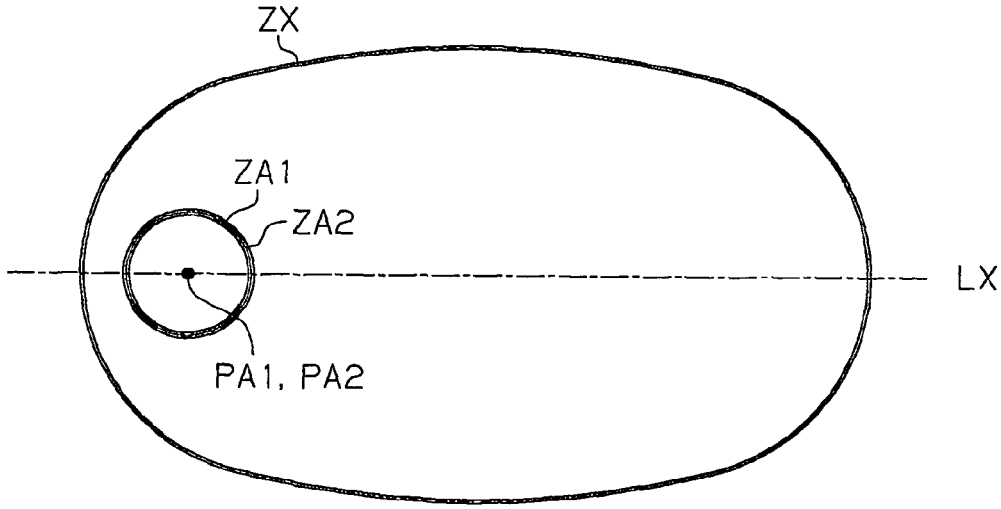
FIG. 23A is a projection view of the inflow inlet in the muffler of FIG. 21.

As shown in FIG. 23A, a first support inlet A is disposed at the muffler main body 41 so that the center PA2 of the second inlet projection view ZA2 is located on the center line LX in height direction AE of the first shell body projection view ZX.

The outflow outlet 8B is located at the center of the muffler main body 41 with respect to height direction AE. The first outlet projection view ZB1 shown in FIG. 23B can be obtained by projecting the outflow outlet 8B shown in FIG. 22 onto the first reference plane FF. The cross-section of the outflow outlet 8B perpendicular to the center line CB1 is referred to as the first reference outflow cross-section FB1. The first outflow projection view ZB1 shown in FIG. 23B can also be obtained by projecting onto the first reference plane FF the shape of the outflow outlet 8B in the first reference outflow cross-section FB1.

Figure 23B:
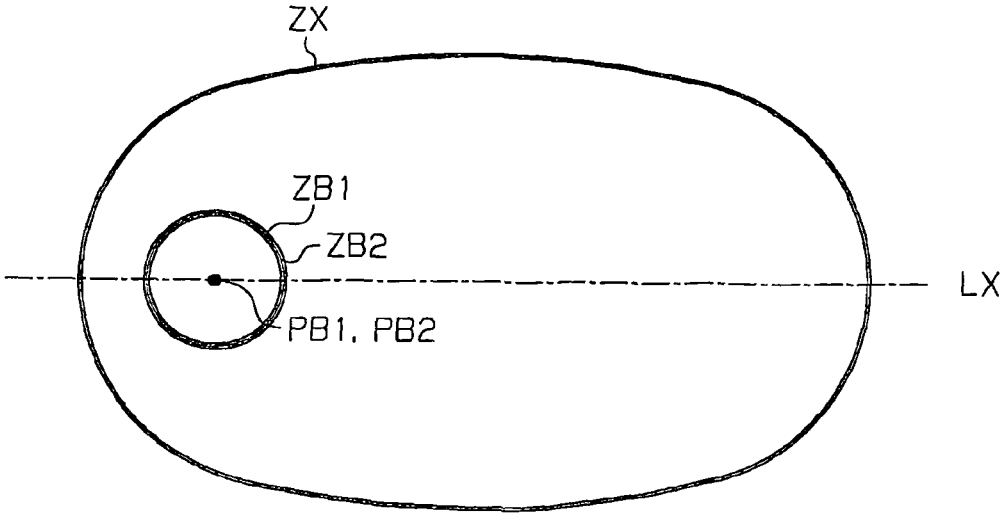
FIG. 23B is a projection view of the outflow outlet in the muffler of FIG. 22.

As shown in FIG. 23B, the outflow outlet 8B is disposed at the muffler main body 41 so that the center PB1 of the first outlet projection view ZB1 is located on the center line LX in height direction AE of the first shell body projection view ZX.

The main body outlet 44A is located at the center of the muffler main body 41 with respect to height direction AE. A second outlet projection view ZB2 shown in FIG. 23B can be obtained by projecting the main body outlet 44A shown in FIG. 22 onto the first reference plane FF. The cross-section of the main body outlet 44A perpendicular to the center line CB2 is referred to as the second reference outlet cross-section FB2. The second outlet projection view ZB2 can also be obtained by projecting onto the first reference plane FF the shape of the first support inlet A in the second reference outlet cross-section FB2.

As shown in FIG. 23B, the main body outlet 44A is disposed at the muffler main body 41 so that the center PB2 of the second outlet projection view ZB2 is located on the center line LX in height direction AE of the first shell body projection view ZX.

Figure 24A:
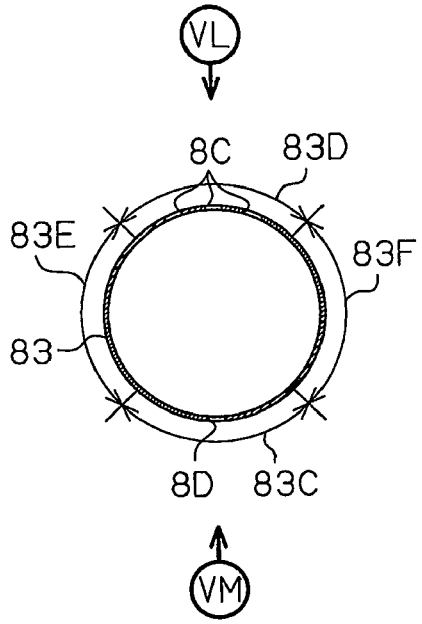
FIG. 24A is a cross-sectional view of the third outflow pipe taken along line DF-DF of FIG. 17A.
Figure 24B:
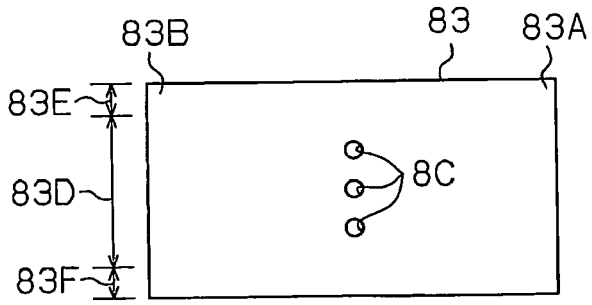
FIG. 24B is a plan view of the third outflow pipe of FIG. 24A as seen in direction VL.
Figure 24C:
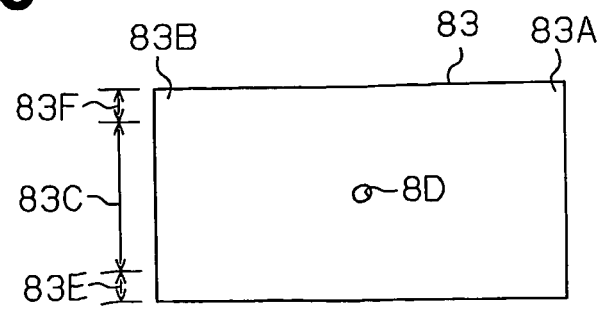
FIG. 24C is a bottom view of the third outflow pipe of FIG. 24A as seen in direction VM.

As shown in FIG. 24A, the third outflow pipe 83 is discriminately referred to as a first portion 83C, a second portion 83D, a third portion 83E, and a fourth portion 83F, with respect to a circumferential direction. The first portion 83C, the second portion 83D, the third portion 83E, and the fourth portion 83F are a first peripheral wall part, a second peripheral wall part, a third peripheral wall part, and a fourth peripheral wall part of the third outflow pipe 83, respectively. The first portion 83C and the second portion 83D are opposite to each other while the third outflow passage 83R is located therebetween, with respect to height direction AE. The first portion 83C of the first muffler 4A configures a bottom part of the outflow pipe 8. The second portion 83D of the second muffler 4B configures a bottom part of the outflow pipe 8. The third portion 83E and the fourth portion 83F each connect the first portion 83C to the second portion 83D.

The three drainage holes 8C are located at the second portion 83D. The sixth through hole 8D is located at the first portion 83C. The third portion 83E and the fourth portion 83F do not have a hole. In the third outflow passage 83R of the first muffler 4A, the condensed water 54 flows onto the first portion 83C. In the third outflow passage 83R of the second muffler 4B, the condensed water 54 flows onto the second portion 83D.

Figure 25:
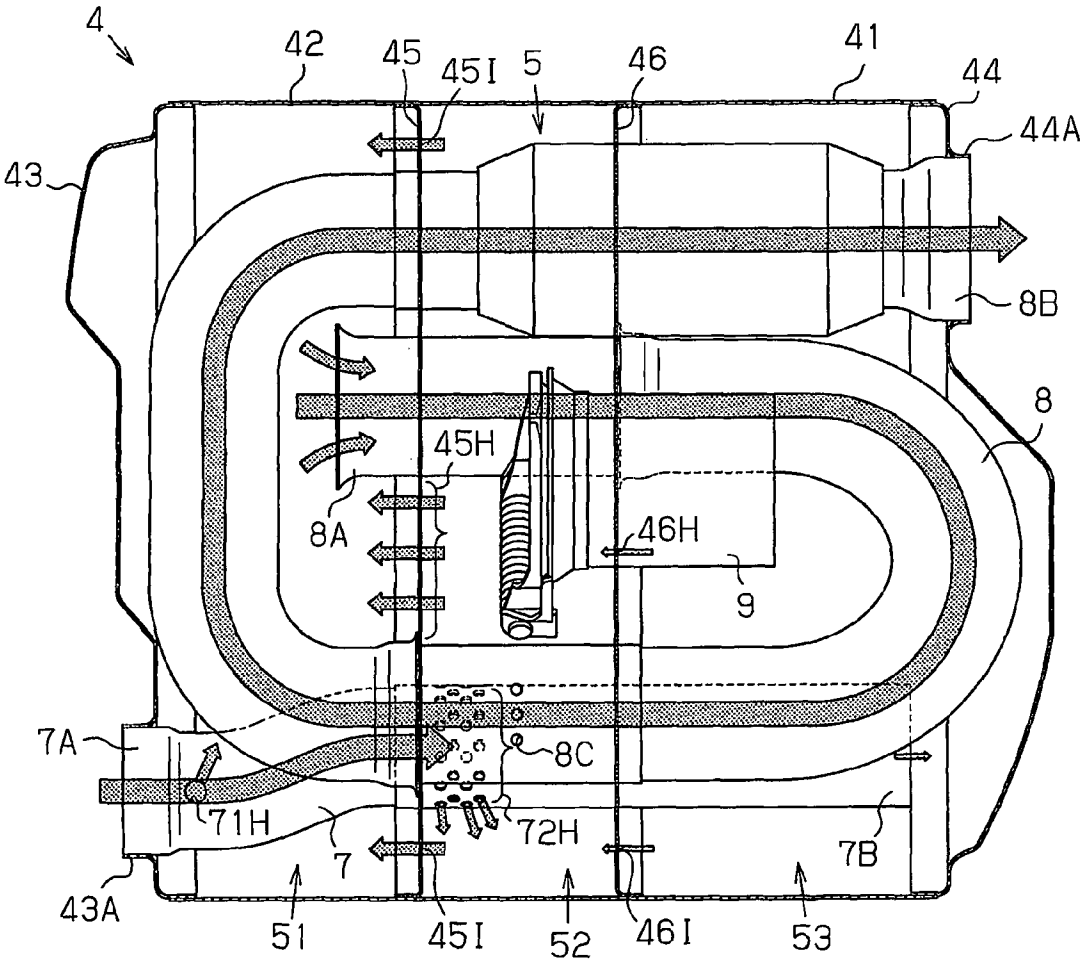
FIG. 25 is a plan view when the valve device of the muffler of FIG. 7 is closed.

FIG. 25 shows the flow of the exhaust within the first muffler 4A when the valve device 91 is closed. Most of the exhaust within the inflow pipe 7 passes through a fifth through hole 72H of the second inflow pipe 72, and then, flows into the second muffling chamber 52. Part of the exhaust within the inflow pipe 7 flows into the first muffling chamber 51 through a fourth through hole 71H of the first inflow pipe 71 or flows into the third muffling chamber 53 from the inflow outlet 7B. Most of the exhaust from the third muffling chamber 53 stays in the third muffling chamber 53 and part of the exhaust from the third muffling chamber 53 flows into the second muffling chamber 52 through each of the third through holes 46H. The exhaust from the second muffling chamber 52 passes through a number of the first through holes 45H and the second through holes 45I of the first separator 45, and then, flows into the first muffling chamber 51. The exhaust from the first muffling chamber 51 flows into the outflow pipe 8 through the outflow inlet 8A, flow in sequential order of the first outflow pipe 81, the second outflow pipe 82, the third outflow pipe 83, the fourth outflow pipe 84, and the fifth outflow pipe 85, and then, is discharged from the outflow outlet 8B to the outside of the muffler main body 41.

As shown in FIG. 25, when the valve device 91 is closed, the degree of expansion of the exhaust flowing into the muffling chamber 5 through the inflow pipe 7 is sufficiently large in comparison with when the valve device 91 is opened. Therefore, an advantageous effect of reduction of exhaust noise is improved. The third muffling chamber 53 functions as a resonance chamber, and thus, the advantageous effect of reduction of exhaust noise with a specific frequency is improved. A small amount of exhaust flows from the third muffling chamber 53 to the second muffling chamber 52 through each of the third through holes 46H. Thus, for example, the degree of reduction of a noise pressure of exhaust noise with a specific frequency is loosened in comparison with a case in which the third through hole 46H does not exist. Therefore, the degree of change in noise pressure relevant to a specific frequency bandwidth is gentle. As a result, a difference between a noise pressure of a specific frequency and a noise pressure of its peripheral frequencies is restrained from becoming excessively large. Such a muffling action reduces exhaust noise when the engine 11 rotates at a low speed. Therefore, the quietness at the time of running at a low speed is improved.

Figure 26:
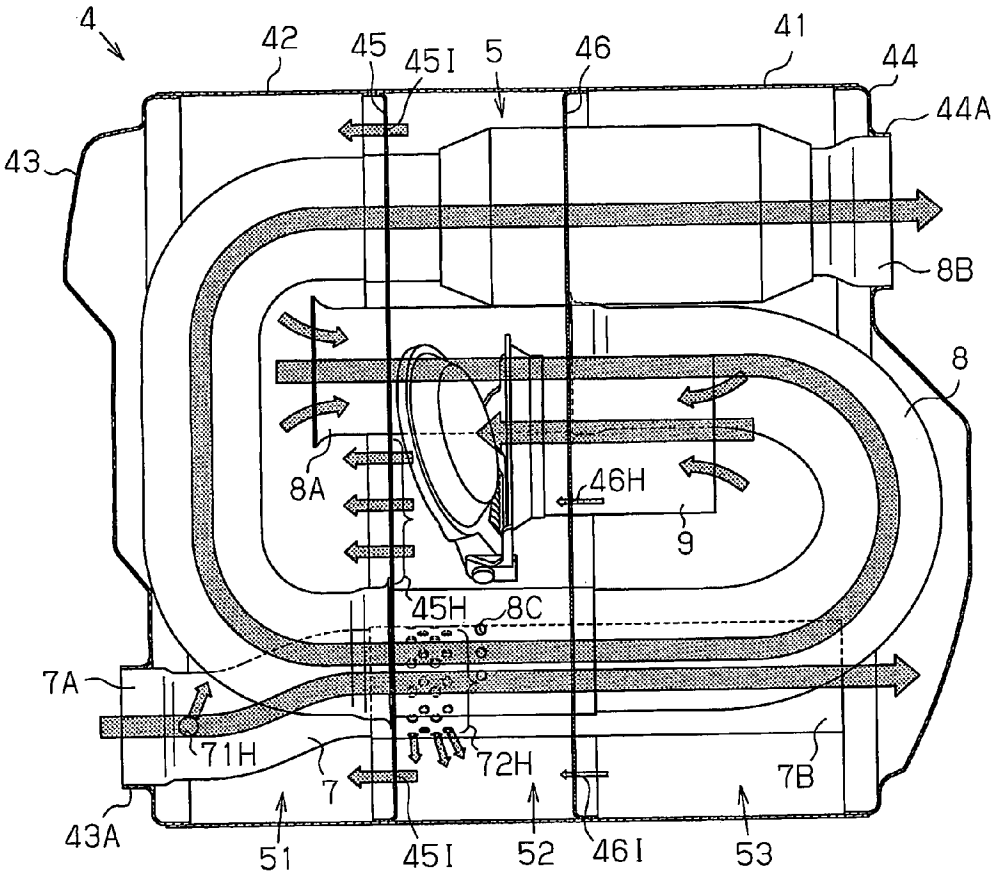
FIG. 26 is a plan view when the valve device of the muffler of FIG. 7 is open.
Figure 27:
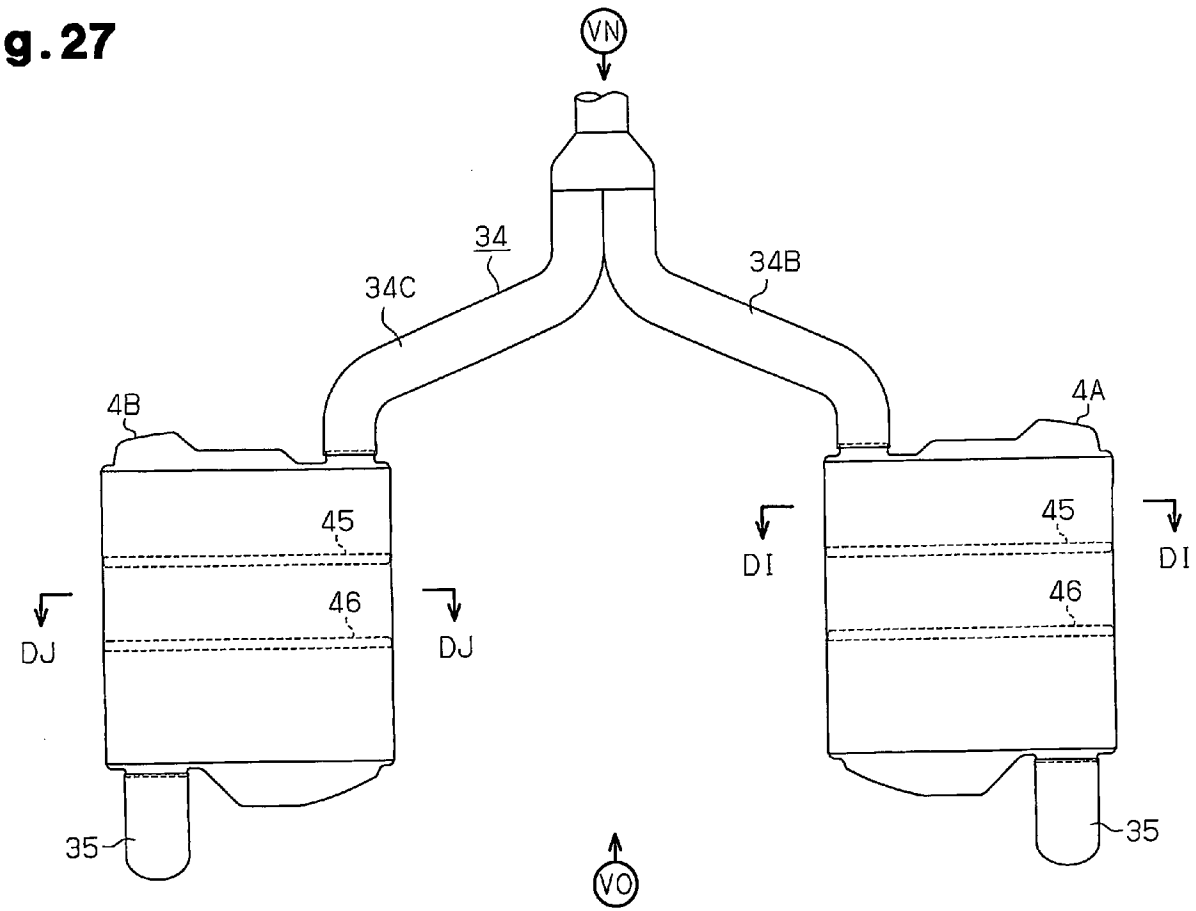
FIG. 27 is a plan view of a pair of the mufflers and the surroundings of the engine exhaust apparatus shown in FIG. 1.

FIG. 26 shows the flow of the exhaust within the first muffler 4A when the valve device 91 is opened. Most of the exhaust within the inflow pipe 7 flows into the third muffling chamber 53 through the inflow outlet 7B. Part of the exhaust from the inflow pipe 7 flows into the first muffling chamber 51 through the fourth through hole 71H of the first inflow pipe 71 or flows into the second muffling chamber 52 through the fifth through hole 72H of the second inflow pipe 72. Most of the exhaust from the third muffling chamber 53 flows into the second muffling chamber 52 through the inner pipe 9, and part of the exhaust from the third muffling chamber 53 flows into the second muffling chamber 52 through each of the third through holes 46H. The exhaust from the second muffling chamber 52 flows into the first muffling chamber 51 through a group of the first through holes 45H of the first separator 45 and each of the second through holes 45I. The exhaust from the first muffling chamber 51 flows into the outflow pipe 8 through the outflow inlet 8A, flows in sequential order through the first outflow pipe 81 to the fifth outflow pipe 85, and then, is discharged from the outflow outlet 8B to the outside of the muffler main body 41.

When the valve device 91 is opened, the resistance of the muffling chamber 5 against an exhaust flow is small in comparison with when the valve device 91 is closed. Namely, a back pressure of the engine 11 is reduced, and then, the power of the engine 11 at the time of high speed rotation is increased.

As shown in FIGS. 28A and 28B, the first muffler 4A in the reference posture is connected to the first branch pipe 34B. The first main body wall 42A of the first muffler 4A is located vertically downwardly of the second main body wall 42B. The first main body wall 42A of the first muffler 4A is opposite to a ground facing surface of the vehicle 1, and then, the second main body wall 42B is opposite to a bottom part of the vehicle 1. The ground facing surface of the vehicle 1 is located vertically downwardly of a bottom part of the vehicle 1. The first muffler 4A and the second muffler 4B are located between the ground facing surface and the bottom part of the vehicle 1.

The second muffler 4B in the inverted posture is connected to the second branch pipe 34C. The second muffler 4B is vertically inverted with respect to the first muffler 4A, and the second main body wall 42B of the second muffler 4B is located vertically downwardly of the first main body wall 42A. The second main body wall 42B of the second muffler 4B is opposite to the ground facing surface of the vehicle 1, and the first main body wall 42A is opposite to the bottom part of the vehicle 1.

The first catalyst converters 23 and the second catalyst converters 24 purify exhaust, whereby water is generated. When the exhaust having passed through the first and second catalyst converters 23, 24 is cooled in the muffler main body 41, the moisture in the exhaust is condensed, and then, the condensed water 54 is generated in the muffler main body 41. The condensed water 54 drops vertically downwardly due to gravity, and then, stays at the bottom part 41A of a respective one of the first muffler 4A and the second muffler 4B. If the condensed water 54 continuously stays at the bottom part 41A, the outer shell 42, the first separator 45, and the second separator 46 corrode, thus making it necessary to discharge the condensed water 54 to the outside of the muffler main body 41.

In a respective one of the first muffler 4A and the second muffler 4B, the outflow inlet 8A opens in the vicinity of the first main body wall 42A, and a drainage hole 8C opens in the vicinity of the second main body wall 42B.

Figure 29A:
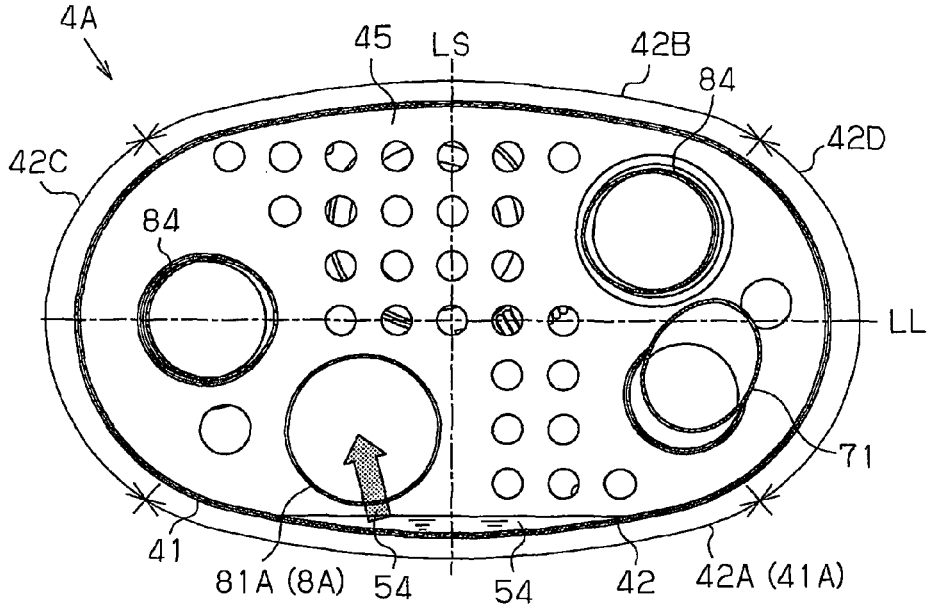
FIG. 29A is a cross-sectional view of the first muffler taken along line DI-DI of FIG. 27.

In the first muffler 4A, the condensed water 54 in the third muffling chamber 53 passes through a gap between the second separator 46 and the outer shell 42, and then, flows into the second muffling chamber 52. The condensed water 54 in the second muffling chamber 52 flows into the first muffling chamber 51 through a gap between the first separator 45 and the outer shell 42. As shown in FIG. 29A, the condensed water 54 staying on the first main body wall 42A (bottom part 41A) of the first muffling chamber 51 of the first muffler 4A flows into the outflow inlet 8A due to an exhaust flow, flows in the outflow pipe 8, and then, is discharged from the outflow outlet 8B to the outside of the muffler main body 41.

Figure 29B:
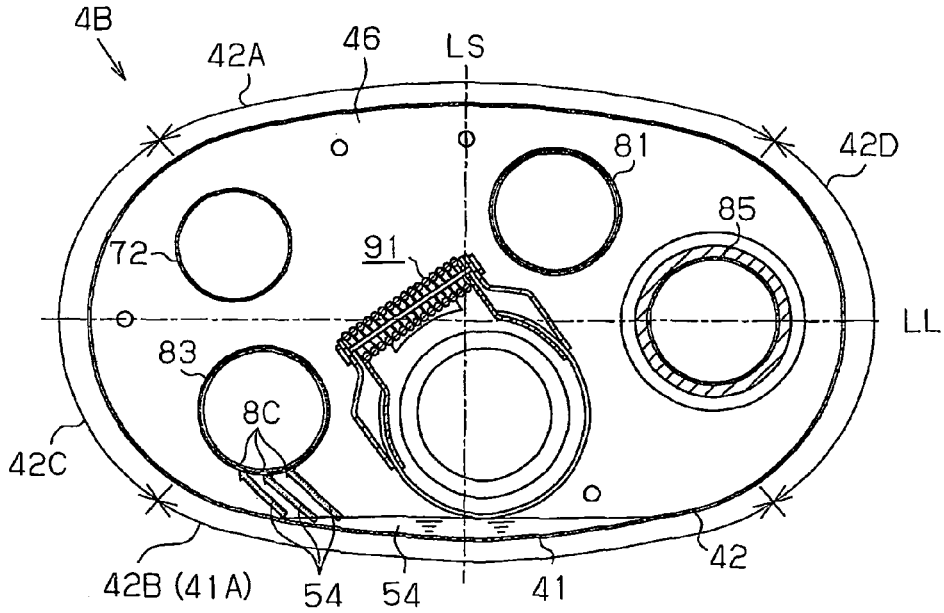
FIG. 29B is a cross-sectional view of the second muffler taken along line DJ-DJ of FIG. 27.

In the second muffler 4B, the condensed water 54 in the first muffling chamber 51 passes through a gap between the first separator 45 and the outer shell 42, and then, flows into the second muffling chamber 52. The condensed water 54 in the third muffling chamber 53 passes through a gap between the second separator 46 and the outer shell 42, and then, flows into the second muffling chamber 52. As shown in FIG. 29B, the condensed water 54 staying on the second main body wall 42B (bottom part 41A) of the second muffling chamber 52 of the second muffler 4B flows into the outflow pipe 8 through the drainage hole 8C due to an exhaust flow, flows the inside of the outflow pipe 8, and then, is discharged from the outflow outlet 8B to the outside of the muffler main body 41.

A method for manufacturing the exhaust apparatus 2 has the following first to fifth steps.

Step 1: Constituent elements of the exhaust apparatus 2 are prepared.

Step 2: The exhaust manifolds 21, 22; the first catalyst converters 23; first and second front pipes 31, 32; the second catalyst converters 24; the first center pipe 33; the sub-muffler 25; and the second center pipe 34 are connected to each other while they are properly mounted on the vehicle 1 or the engine 11. These constituent elements can be mounted on the vehicle 1 after a plurality of members have been assembled with each other. For example, the first center pipe 33 is mounted on the vehicle 1 after it has been assembled with the second catalyst converter 24 in advance.

Step 3: The tail pipe 35 is mounted on a respective one of the first muffler 4A and the second muffler 4B.

Step 4: The first muffler 4A in the reference posture is connected to the first branch pipe 34B.

Step 5: The second muffler 4B in the inverted posture is connected to the second branch pipe 34C.

The exhaust apparatus 2 may be incorporated in the vehicle 1 after assembled without being assembled on the vehicle.

The exhaust apparatus 2 of the first embodiment has the following advantages.

(1) The exhaust apparatus 2 is provided with: the first muffler 4A set in reference posture; and the second muffler 4B set in inverted posture. Namely, the first muffler 4A and the second muffler 4B arranged in the transverse direction of the vehicle 1 each have the same structure, so that the cost of the exhaust apparatus 2 can be reduced. In other words, the first muffler 4A and the second muffler 4B that are parallel to each other in the fore-and-aft direction of the vehicle 1 each have the same muffler main body 41.

(2) The outflow pipe 8 has: the outflow inlet 8A that opens in the vicinity of the first main body wall 42A; and the drainage hole 8C that opens in the vicinity of the second main body wall 42B. Therefore, the condensed water 54 staying at a bottom part 41A of the first muffler 4A flows into the outflow pipe 8 through the outflow inlet 8A. The condensed water 54 staying at the bottom part 41A of the second muffler 4B flows into the outflow pipe 8 through the drainage hole 8C. Thus, the condensed water 54 is discharged from both of the first muffler 4A and the second muffler 4B to the outside of the muffler main body 41. Therefore, the common use of the first muffler 4A and the second muffler 4B can be compatible with the discharge property of the condensed water 54 from the first muffler 4A and the second muffler 4B. The condensed water 54 is prevented from staying at the bottom part of the muffler main body 41, and thus, the corrosion of the outer shell 42, the first separator 45, and the second separator 46 is restricted. Thus, the practicability of the first muffler 4A and the second muffler 4B is improved. The outflow pipe 8 is formed in a double U shape having two U shapes, so that the outflow inlet 8A opening in the vicinity of the first main body wall 42A and the drainage hole 8C opening in the vicinity of the second main body wall 42B can be reliably provided.

(3) With respect to height direction AE, the outflow outlet 8B is located at the center of the muffler main body 41. Therefore, the layouts of the outflow outlet 8B of the first muffler 4A seen from the rear, i.e., at the downstream side of the exhaust apparatus 2 and the outflow outlet 8B of the second muffler 4B is symmetrical. Therefore, the appearance of the vehicle 1 is improved. Therefore, the common use of the first muffler 4A and the second muffler 4B can be compatible with the transverse symmetry of the backward layouts of the first muffler 4A and the second muffler 4B.

Assuming that a pair of the conventional mufflers is provided, and then, each of them is connected to the exhaust pipe 3, the layouts are not always symmetrical. The present embodiment improves this matter.

(4) The main body outlet 44A of the second external plate 44 is located at the center of height direction AE, and then, the main body outlet 44A supports the outflow outlet 8B. Therefore, the layouts of the first muffler 4A and the second muffler 4B seen from the rear, i.e., from the downstream side of the exhaust apparatus 2 are perfectly symmetrical. In other words, the rear shape of the first muffler 4A is perfectly symmetrical to that of the second muffler 4B with respect to the center in width direction AF of the vehicle 1. Therefore, the appearance of the vehicle 1 is remarkably improved.

(5) The inflow inlet 7A is located at the center of the muffler main body 41 with respect to height direction AE. Therefore, the layouts of the inflow inlet 7A of the first muffler 4A seen from the front, i.e., from the upstream side of the exhaust apparatus 2 and the inflow inlet 7A of the second muffler 4B are symmetrical. Therefore, the appearance of the vehicle 1 is improved. Therefore, the common use of the first muffler 4A and the second muffler 4B can be compatible with the symmetry of the layouts when the first muffler 4A and the second muffler 4B are seen from the front.

(6) The first support inlet A of the first external plate 43 is located at the center of height direction AE. The inflow inlet 7A supports the first support inlet A. Therefore, the layouts of the first muffler 4A and the second muffler 4B seen from the front, i.e., from the upstream side of the exhaust apparatus 2 are perfectly symmetrical. In other words, a frontal shape of the first muffler 4A and a frontal shape of the second muffler 4B are perfectly symmetrical with respect to the center in width direction AF of the vehicle 1.

(7) The inflow inlet 7A is located at the center of the muffler main body 41 with respect to height direction AE. Therefore, defining the length of the first branch pipe 34B connected to the first muffler 4A to be equal to that of the second branch pipe 34C connected to the second muffler 4B can be compatible with laying out the main pipe 34A at the center in width direction AF of the vehicle 1. Therefore, the layouts of the exhaust pipe 3, the first muffler 4A, and the second muffler 4B are improved.

Assuming that the conventional mufflers are employed, defining the length of the first branch pipe 34B to be equal to that of the second branch pipe 34C is not always compatible with laying out the main pipe 34A at the center in the width direction of the vehicle 1. The present embodiment improves this matter.

(8) The inflow inlet 7A is located at the center of the muffler main body 41 with respect to height direction AE. Namely, in both of the first muffler 4A and the second muffler 4B also, the position of the inflow inlet 7A is identical with respect to height direction AE. Therefore, the earlier backflow of condensed water 54 from the muffler main body 41 to the upstream from either one of the first muffler 4A and the second muffler 4B hardly occurs. Therefore, the common use of the first muffler 4A and the second muffler 4B is compatible with the restriction of the backflow of the condensed water 54 from the first muffler 4A and the second muffler 4B.

Assumedly, in a state in which the vehicle 1 is inclined and stops, in the case where the upstream side of the first muffler 4A is lower than the downstream side, if a large amount of condensed water 54 occurs with the first muffler 4A, the condensed water 54 may backflow from the inflow pipe 7 to the upstream side. In addition, assumedly, in the case where the inflow inlet 7A is not located at the center of height direction AE, there is a high possibility that the condensed water 54 outflows to the upstream side earlier from either one of the first muffler 4A and the second muffler 4B. However, the present embodiment prevents these matters.

(9) The third outflow pipe 83 has the drainage hole 8C for allowing the condensed water 54 of the second muffler 4B to flow into the outflow pipe 8. Therefore, there is no need for an additional pipe for allowing the condensed water 54 to flow into the outflow pipe 8. In other words, there is no need for branching part of the outflow pipe 8. Thus, a structure of the first muffler 4A is simplified, enabling cost reduction. In addition, in the case where it is permissible to provide an additional pipe at the outflow pipe 8, the condensed water 54 of the second muffler 4B can be discharged from such additional pipe to the outside of the muffler main body 41.

(10) The outflow pipe 8 includes the first outflow pipe 81 to the fifth outflow pipe 85 that are connected in series. Therefore, even with the outflow pipe 8 having two U shapes, a change in the direction of an exhaust flow is comparatively gentle. Thus, a resistance against the exhaust flow can be reduced. Therefore, the increase in the power of the engine 11 can be compatible with discharging out the condensed water 54 of the first muffler 4A and the second muffler 4B to the outside.

(11) The first muffler 4A and the second muffler 4B are each connected to the second center pipe 34 in a state in which the first and second mufflers 4A, 4B are vertically inverted with respect to each other. The first muffler 4A and the second muffler 4B each have the same structure, thus enabling cost reduction.

The first embodiment described above may be modified as follows.

The sixth through hole 8D may be eliminated from the first portion 83C of the third outflow pipe 83. Namely, the third outflow pipe 83 has only the drainage hole 8C located at the second portion 83D.

The main body outlet 44A of the second external plate 44 may support a portion of the outflow pipe 8 at the upstream side rather than the outflow outlet 8B without being limited to supporting the outflow outlet 8B of the outflow pipe 8. In this case, a portion of the outflow pipe 8 from the main body outlet 44A up to the outflow outlet 8B is formed so as to extend straight. As a result, the layouts when the first muffler 4A and the second muffler 4B are seen from the rear of the exhaust apparatus 2 can be symmetrical, and the appearance of the vehicle 1 can be improved.

The first support inlet A of the first external plate 43 may support a portion of the inflow pipe 7 at the downstream side rather than the inflow inlet 7A without being limited to supporting the inflow inlet 7A of the inflow pipe 7. In this case, a portion of the inflow pipe 7 from the first support inlet A to the inflow inlet 7A is formed so as to extend straight. As a result, the layouts of the first muffler 4A and the second muffler 4B seen from the front of the vehicle 1 can be symmetrical. In this case, defining the length of the first branch pipe 34B connected to the first muffler 4A to be equal to that of the second branch pipe 34C connected to the second muffler 4B can be compatible with laying out the main pipe 34A at the center in the width direction of the vehicle 1.

Figure 30:
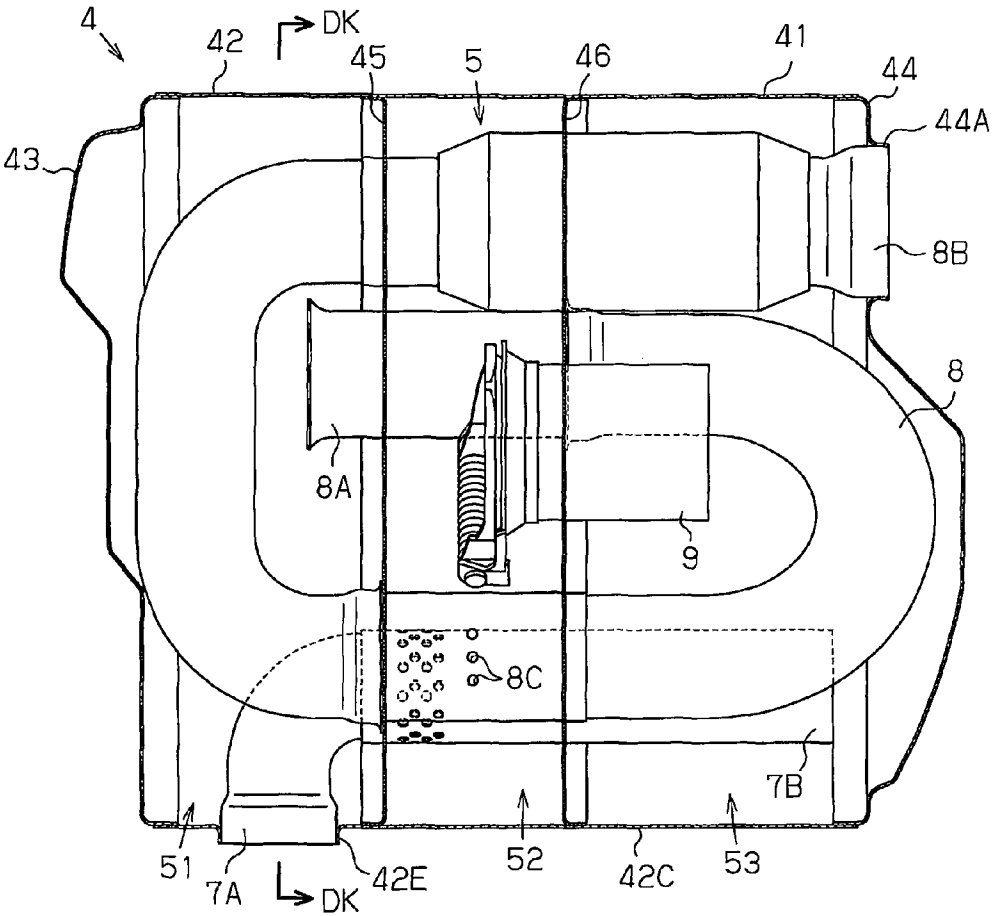
FIG. 30 is a plan view of a muffler according to a second embodiment of the present invention.
Figure 31A:
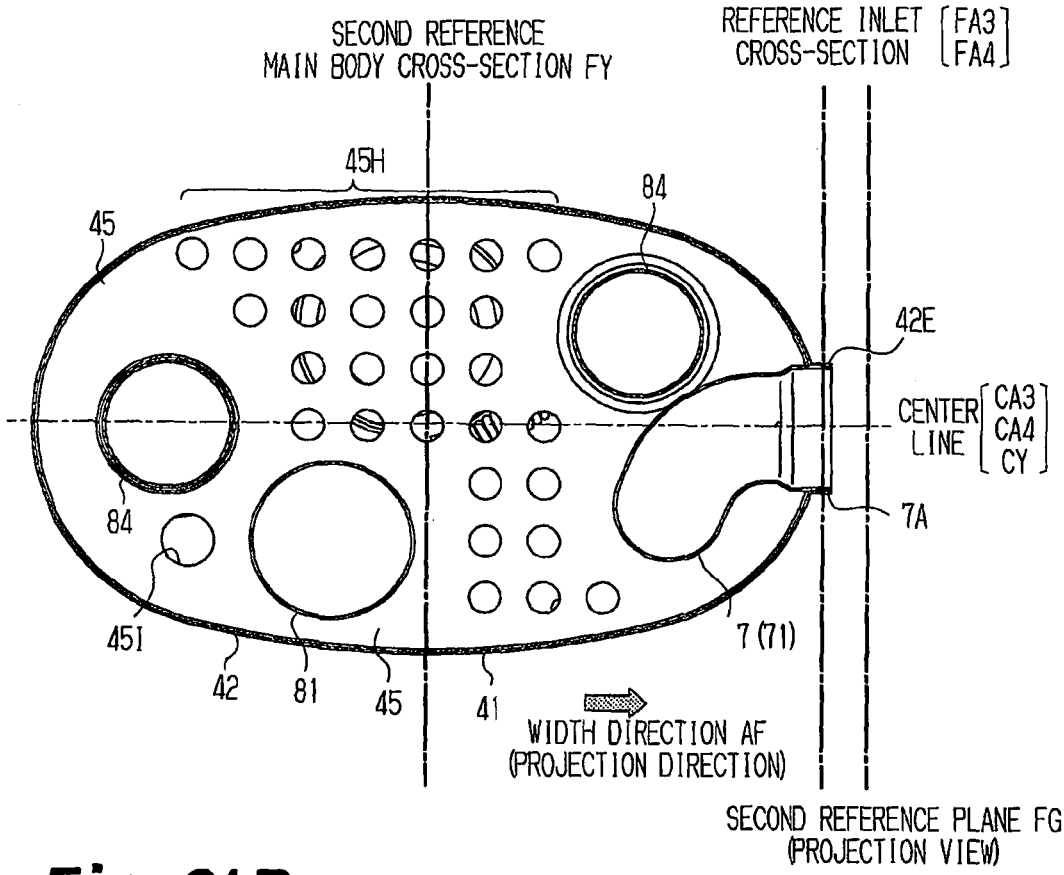
FIG. 31A is a cross-sectional view of the muffler taken along line DK-DK of FIG. 30.
Figure 31B:
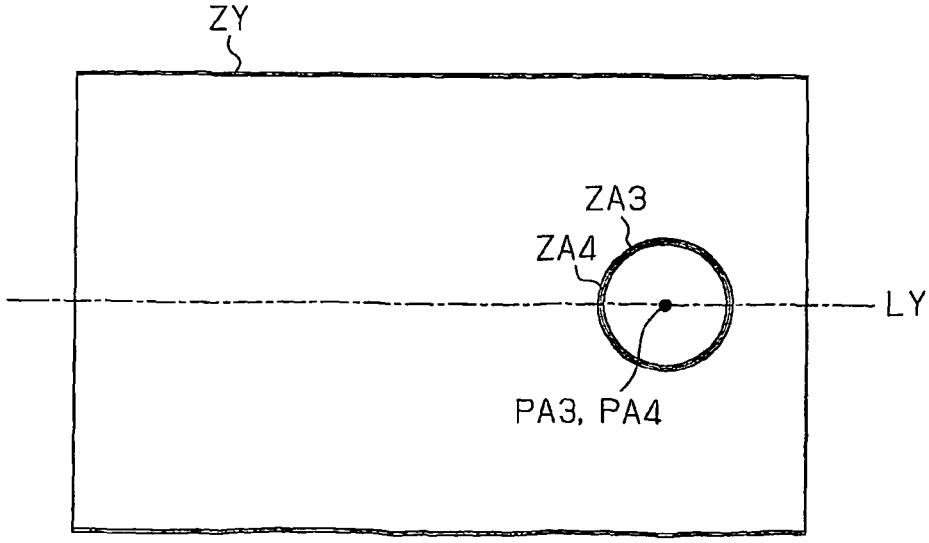
FIG. 31B is a projection view in a width direction, of the muffler of FIG. 31A.

FIGS. 30 to 31B show a second embodiment of the present invention. An exhaust apparatus of the second embodiment is partially different from the exhaust apparatus of the first embodiment. Constituent elements common to those of the first embodiment are denoted by the same reference numerals.

As shown in FIG. 30, the third main body wall 42C of the outer shell 42 has a second main body inlet 42E serving as a main body opening that supports the inflow inlet 7A of the inflow pipe 7. The inflow pipe 7 is bent at 90 degrees. As a result, the first support inlet A has been omitted from the first external plate 43.

FIGS. 31A and 31B show positions of openings of the inflow pipe 7 and the outer shell 42 relative to the muffler main body 41.

As shown in FIG. 31A, the inflow inlet 7A of the second embodiment is set at the center of the muffler main body 41 with respect to height direction AE. A plane taken along longitudinal direction AG and height direction AE of the muffler main body 41 is referred to as second reference plane FG. In other words, the second reference plane FG is perpendicular to width direction AF. A second shell body projection view ZY serving as a second main body projection view shown in FIG. 31B can be obtained by projecting the outer shell 42 onto the second reference plane FG. The projection direction of the outer shell 42 onto the second reference plane FG is width direction AF of the muffler main body 41. A third inlet projection view ZA3 shown in FIG. 31B can be obtained by projecting the inflow inlet 7A onto the second reference plane FG. A cross-section perpendicular to the center line CY in height direction AE of the outer shell 42 is referred to as a second reference main body cross-section FY. The second shell body projection view ZY can also be obtained by projecting onto the second reference plane FG the shape of the outer shell 42 in the second reference main body cross-section FY. A cross-section perpendicular to the center line CA3 of the inflow inlet 7A is referred to as a third reference inlet cross-section FA3. The third inlet projection view ZA3 can also be obtained by projecting onto the second reference plane FG the shape of the inflow inlet 7A in the third reference inlet cross-section FA3.

As shown in FIG. 31B, the inflow inlet 7A is disposed at the muffler main body 41 so that the center PA3 of the third inlet projection view ZA3 is located on the center line LY in height direction AE of the second shell body projection view ZY.

As shown in FIG. 31A, a second main body inlet 42E is located at the center of the muffler main body 41 with respect to height direction AE. A fourth inlet projection view ZA4 can be obtained by projecting the second main body inlet 42E onto the second reference plane FG. A cross-section perpendicular to the center line CA4 of the second main body inlet 42E is referred to as a fourth reference inlet cross-section FA4. The fourth inlet projection view ZA4 can also be obtained by projecting onto the second reference plane FG the shape of the second main body inlet 42E in the fourth reference inlet cross-section FA4.

As shown in FIG. 31B, the second main body inlet 42E is disposed at the muffler main body 41 so that the center PA4 of the fourth inlet projection view ZA4 is located on the center line LY in height direction AE of the second shell body projection view ZY.

The second embodiment has advantages that are similar to the advantages (1) to (10) of the first embodiment.

Figure 32:
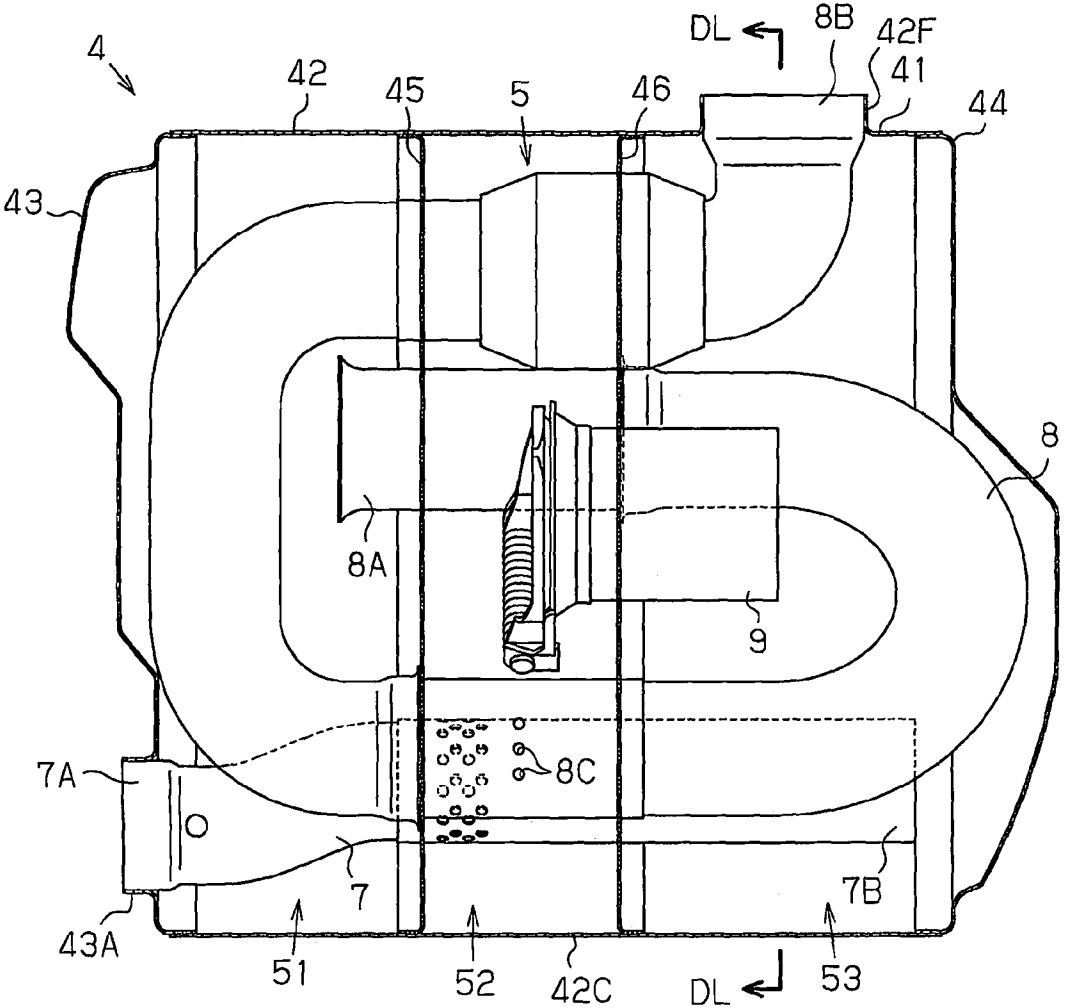
FIG. 32 is a plan view of a muffler according to a third embodiment of the present invention.
Figure 33A:
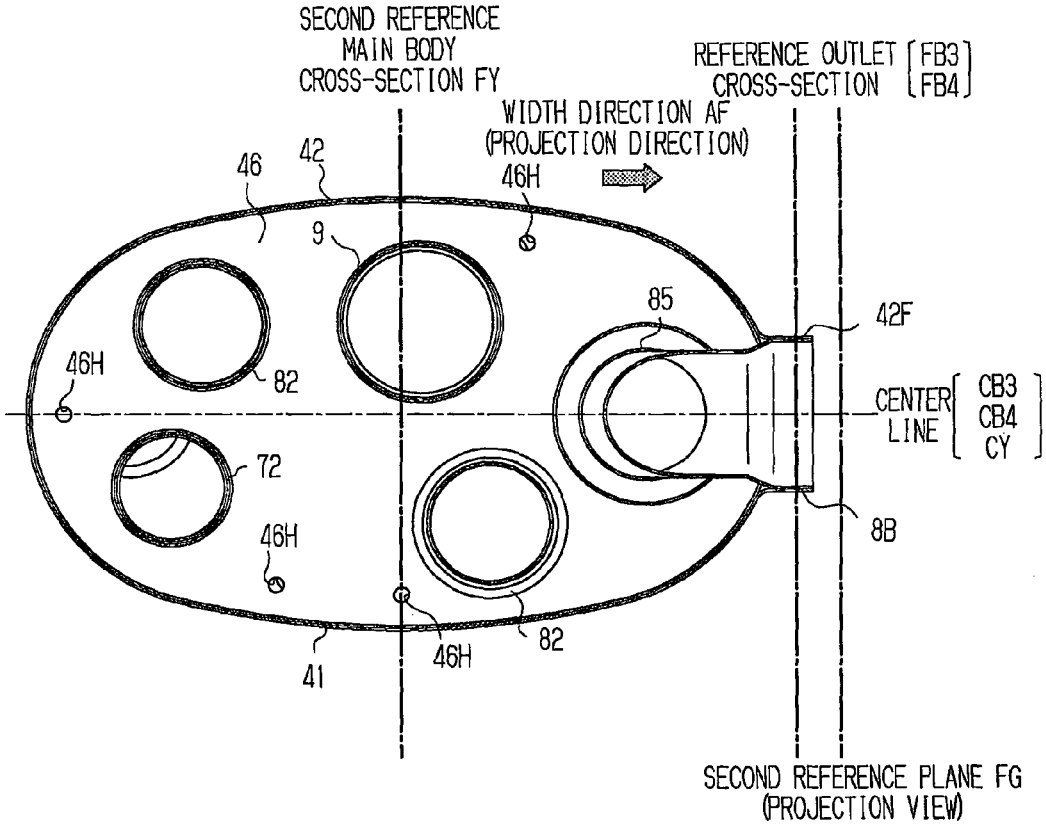
FIG. 33A is a cross-sectional view of the muffler taken along line DL-DL of FIG. 32.
Figure 33A:
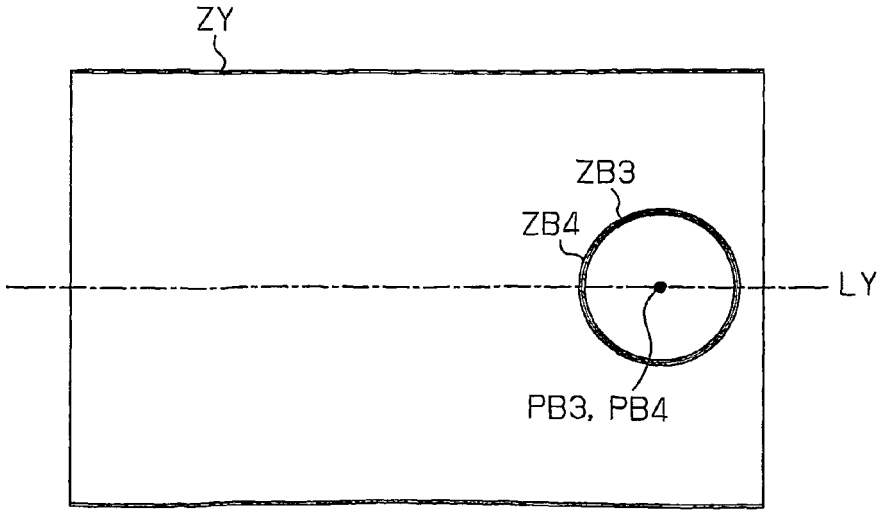

FIGS. 32 to 33B show a third embodiment of the present invention. As shown in FIG. 32, the fourth main body wall 42D of the outer shell 42 has a second main body outlet 42F that serves as a main body opening for supporting the outflow outlet 8B of the outflow pipe 8. The fifth outflow pipe 85 is bent at 90 degrees. The main body outlet 44A is omitted from the second external plate 44.

As shown in FIG. 33A, the outflow outlet 8B is located at the center of the muffler main body 41 with respect to height direction AE. A plane taken along longitudinal direction AG of the muffler main body 41 is referred to as second reference plane FG. A second shell body projection view ZY can be obtained by projecting the outer shell 42 onto the second reference plane FG. A third outlet projection view ZB3 can be obtained by projecting the outflow outlet 8B onto the second reference plane FG. A cross-section perpendicular to the center line CB3 of the outflow outlet 8B is referred to as a third reference outlet cross-section FB3. The third outlet projection view ZB3 can also be obtained by projecting onto the second reference plane FG the shape of the outflow outlet 8B in the third reference outlet cross-section FB3.

As shown in FIG. 33B, the outflow outlet 8B is disposed at the muffler main body 41 so that the center PB3 of the third outlet projection view ZB3 is located on the center line LY in height direction AE of the second shell body projection view ZY.

As shown in FIG. 33A, the second main body outlet 42F is located at the center of the muffler main body 41 with respect to height direction AE. A fourth outlet projection view ZB4 can be obtained by projecting the second main body outlet 42F onto the second reference plane FG. A cross-section perpendicular to the center line CB4 of the second main body outlet 42F is referred to as a fourth reference outlet cross-section F34. The fourth outlet projection view ZB4 can also be obtained by projecting onto the second reference plane FG the shape of the second main body outlet 42F in the fourth reference outlet cross-section FB4.

As shown in FIG. 33B, the second main body outlet 42F is disposed at the muffler main body 41 so that the center PB4 of the fourth outlet projection view ZB4 is located on the center line LY in height direction AE of the second shell body projection view ZY.

The third embodiment has advantages that are similar to the advantages (1) to (10) of the first embodiment.

Figure 34A:
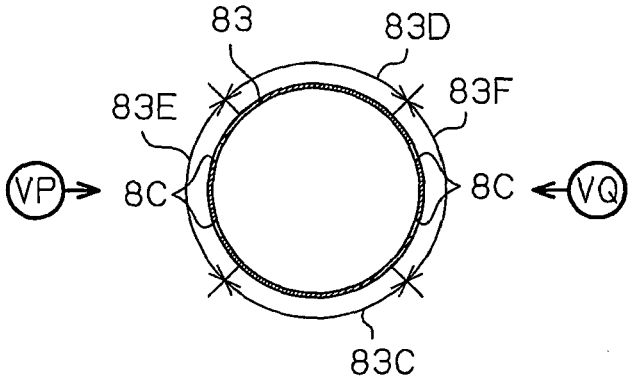
FIG. 34A is a cross-sectional view of a third outflow pipe included in a muffler of a fourth embodiment of the present invention.
Figure 34B:
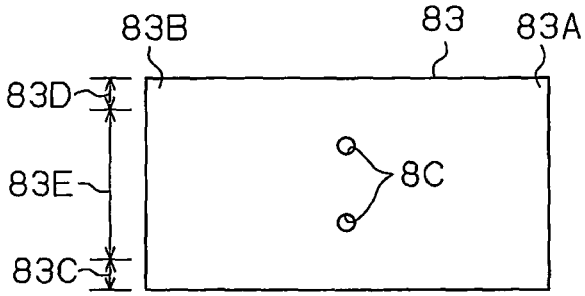
FIG. 34B is a side view of a third outflow pipe of FIG. 34A as seen in direction VP.
Figure 34C:
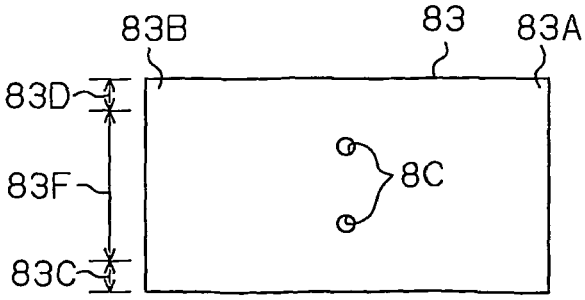
FIG. 34C is a side view of the third outflow pipe of FIG. 34A as seen in direction VQ.

FIGS. 34A to 34C show a fourth embodiment of the present invention.

In the third outflow pipe 83, the third portion 83E and the fourth portion 83F each have two drainage holes 8C. In other words, the third portion 83E and the fourth portion 83F opposite to each other in width direction AF while the third outflow passage 83R is located therebetween have the drainage holes 8C, respectively. No hole is provided at the first portion 83C and the second portion 83D.

The fourth embodiment has the advantages (1) to (10) of the first embodiment and the following advantages.

(12) In the third outflow pipe 83, the drainage holes 8C exist at only the third portion 83E and the fourth portion 83F. Therefore, the condensed water 54 having flowed into the outflow pipe 8 through the outflow inlet 8A in the first muffler 4A is restricted from flowing to the outside of the outflow pipe 8 prior to arrival at the outflow outlet 8B.

The fourth embodiment may be changed as follows.

The drainage holes 8C of the third outflow pipe 83 may exist at either of the third portion 83E and the fourth portion 83F without being limited to the configuration in which the drainage holes exist at both of these portions. The drainage holes 8C may be provided at any one of the second portion 83D to the fourth portion 83F.

Figure 35:
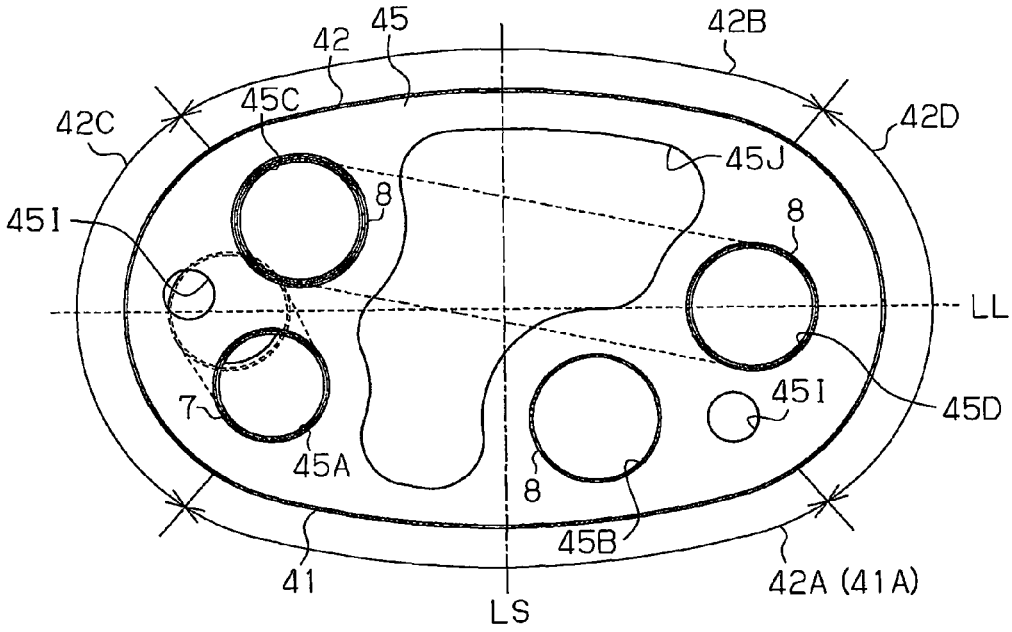
FIG. 35 is a cross-sectional view similar to FIG. 5, of a muffler according to a fifth embodiment of the present invention.
Figure 36:
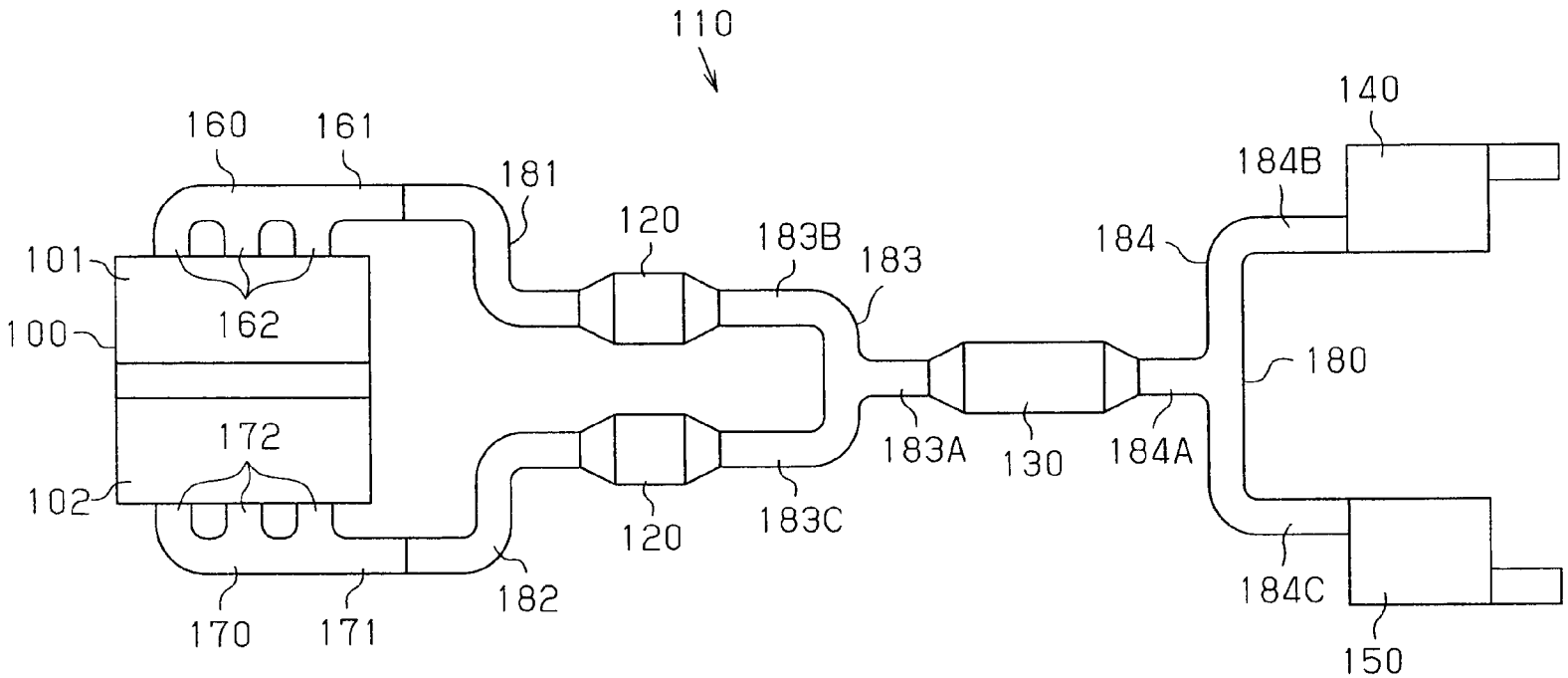
Fig.36(Prior Art)
FIG. 36 is a plan view of a general engine exhaust apparatus.

FIG. 35 shows a fifth embodiment of the present invention.

The first separator 45 of the fifth embodiment has a seventh through hole 45J in place of a number of the first through holes 45H. In order to ensure a flow rate of exhaust from the second muffling chamber 52 to the first muffling chamber 51, the seventh through hole 45J is maximized in size, as long as the strength of the first separator 45 is allocated.

The fifth embodiment has advantages similar to the advantages (1) to (10) of the first embodiment.

The embodiments described above may be modified as follows.

The drainage holes 8C may be provided at the second outflow pipe 82 or the fourth outflow pipe 84 without being limited to the configuration in which the holes are provided at the third outflow pipe 83. For example, the drainage holes 8C are provided at a portion of the second outflow pipe 82 that is adjacent to the second main body wall 42B, i.e., at a second wall facing part. The second wall facing part corresponds to the second outflow outlet 82B and its periphery. In addition, the drainage holes 8C are provided at a portion of the fourth outflow pipe 84 that is adjacent to the second main body wall 42B, i.e., at the fourth wall facing part. The fourth wall facing part corresponds to the fourth outflow inlet 84A and its periphery.

The drainage holes 8C may be eliminated from the third outflow pipe 83. In this case, an opening of a branch pipe that branches part of the outflow pipe 8 is disposed in the vicinity of the second main body wall 42B. The condensed water 54 of the second muffler 4B can be discharged to the outside by means of the branch pipe.

A second drainage hole similar to the drainage hole 8C may be provided at the outflow pipe 8 without being limited to the configuration in which the condensed water 54 of the first muffler 4A is taken from the outflow inlet 8A into the outflow pipe 8. A second drainage hole is disposed in the vicinity of the first main body wall 42A.

Instead of being formed by the first inflow pipe 71 and the second inflow pipe 72, the inflow pipe 7 may be formed of a single pipe, or may be formed of three or more pipes.

Instead of being formed by the first outflow pipe 81 to the fifth outflow pipe 85, the outflow pipe 8 may be formed by one to four pipes, or six or more pipes.

The main pipe 33A of the first center pipe 33 does not need to be located at the center in width direction AD of the vehicle 1, but may be displaced from the center.

The length of the first branch pipe 33B of the first center pipe 33 do not need to be equal to the length of the second branch pipe 33C, but may be different.

The main pipe 34A of the second center pipe 34 does need to be located at the center in width direction AD of the vehicle 1, but may be displaced from the center.

The length of the first branch pipe 34B of the second center pipe 34 does not need to be equal to the length of the second branch pipe 34C, but may be different.

The second embodiment may be combined with the third embodiment.

Not only one muffler but also a plurality of mufflers may be connected to the first branch pipe 34B of the second center pipe 34. Mufflers as many as those connected to the first branch pipe 34B are connected to the second branch pipe 34C.

In addition to the first branch pipe 34B and the second branch pipe 34C, the second center pipe 34 may be provided with a third branch pipe and a fourth branch pipe. The mufflers connected to the third branch pipe and the fourth branch pipe are also vertically inverted with respect to each other.

In the illustrated embodiments, the exhaust apparatus 2 is provided with one pair of the first muffler 4A and the second muffler 4B. However, the exhaust apparatus 2 may be provided with two or more pairs of the first muffler 4A and the second muffler 4B. For example, the exhaust apparatus 2 may be provided with an upstream side first pair and a downstream side second pair. The first pair is provided with a first muffler 4A and a second muffler 4B, and the second pair is also provided with a first muffler 4A and a second muffler 4B.

The cylinder arrangement of the engine 11 is not limited to a V-type. The exhaust apparatus 2 can be modified in response to the cylinder arrangement, as required.

The invention claimed is:

1. An exhaust apparatus for an engine of a vehicle, the exhaust apparatus comprising:

an exhaust pipe through which exhaust of the engine flows; and a first muffler and a second muffler arranged in a transverse direction of the vehicle, the first muffler and the second muffler being connected to the exhaust pipe while being vertically inverted with respect to each other, wherein the first muffler and the second muffler each includes:

a muffler main body having a muffling chamber for muffling the exhaust;

an inflow pipe for allowing exhaust of the exhaust pipe to flow into the muffling chamber; and an outflow pipe for discharging exhaust of the muffling chamber to the outside, wherein each of the muffler main body has a first main body wall and a second main body wall that are opposite to each other in a height direction, the muffling chamber existing between the first main body wall and the second main body wall, and wherein each of the outflow pipe has: a first opening that connects a passage of the outflow pipe with the muffling chamber, the first opening being adjacent to the first main body wall; and a second opening that connects a passage of the outflow pipe with the muffling chamber, the second opening being adjacent to the second main body wall.

2. The exhaust apparatus according to claim 1, wherein the first main body wall of the first muffler exists vertically downwardly of the second main body wall of the first muffler, wherein a liquid staying on the first main body wall of the first muffler can flow into a passage of the outflow pipe through the first opening, and wherein the second main body wall of the second muffler is located vertically downwardly of the first main body wall of the second muffler, wherein a liquid staying on the second main body wall of the second muffler can flow into a passage of the outflow pipe through the second opening.

3. The exhaust apparatus according to claim 1, wherein the outflow pipe has an outflow outlet from which exhaust outflows, the outflow outlet being positioned at a center in a height direction of the muffler main body.

4. The exhaust apparatus according to claim 3, wherein the muffler main body has a main body outlet for supporting the outflow outlet, and wherein the main body outlet is positioned at a center of a height direction of the muffler main body.

5. The exhaust apparatus according to claim 4, wherein the outflow outlet extends through the main body outlet and then, is disposed at the outside of the muffler main body, wherein a portion of the outflow pipe located at the outside of the muffler main body extends straight.

6. The exhaust apparatus according to claim 1, wherein the muffler main body includes:

a cylindrical shell body defining the muffling chamber, the shell body having a first mouth and a second mouth that is opposite to the first mouth, the shell body defining a first reference plane that is perpendicular to a longitudinal direction of the cylinder;

a first exterior wall closing the first mouth; and a second exterior wall closing the second mouth, the second exterior wall having a main body outlet for supporting the outflow pipe, wherein the outflow pipe having an outflow outlet from which exhaust outflows, wherein a first shell body projection view is obtained by projecting the shell body onto the first reference plane, wherein a first outlet projection view is obtained by projecting the outflow outlet onto the first reference plane, wherein a second outlet projection view is obtained by projecting the main body outlet onto the first reference plane, and wherein at least one of a center of the first outlet projection view and a center of the second outlet projection view is located at a center in a height direction of the first shell body projection view.

7. The exhaust apparatus according to claim 1, wherein the muffler main body includes:

a shell body having the muffling chamber therein, the shell body being formed in a cylindrical shape and having a first mouth and a second mouth that is opposite to the first mouth, a side part of the shell body having a main body outlet for supporting the outflow pipe, the shell body defining a second reference plane that is parallel to a longitudinal direction and a height direction of the cylinder, wherein the outflow pipe has an outflow outlet from which exhaust outflows, wherein a second shell body projection view is obtained by projecting the shell body onto the second reference plane, wherein a third outlet projection view is obtained by projecting the outflow outlet onto the second reference plane, wherein a fourth outlet projection view is obtained by projecting the main body outlet onto the second reference plane, and wherein at least one of a center of the third outlet projection view and a center of the fourth outlet projection view is located at a center in a height direction of the second shell body projection view.

8. The exhaust apparatus according to claim 1, wherein the inflow pipe has an inflow inlet into which exhaust flows, and wherein the inflow inlet is located at a center in a height direction of the muffler main body.

9. The exhaust apparatus according to claim 8, wherein the muffler main body has a main body inlet for supporting the inflow pipe, and wherein the main body inlet is located at a center of a height direction of the muffler main body.

10. The exhaust apparatus according to claim 9, wherein the inflow inlet extends through the main body inlet and exists at the outside of the muffler main body, wherein a portion of the inflow pipe located at the outside of the muffler main body extends straight.

11. The exhaust apparatus according to claim 8, wherein the muffler main body includes:

a cylindrical shell body defining the muffling chamber, the shell body having a first mouth and a second mouth that is opposite to the first mouth, the shell body defining a first reference plane that is perpendicular to a longitudinal direction of the cylinder;

a first exterior wall closing the first mouth, the first exterior wall having a main body inlet for supporting the inflow pipe; and a second exterior wall closing the second mouth, wherein the inflow pipe has an inflow inlet into which exhaust flows, wherein a first shell body projection view is obtained by projecting the first exterior wall onto the first reference plane, wherein a first inlet projection view is obtained by projecting the inflow inlet onto the first reference plane, wherein a second inlet projection view is obtained by projecting the main body inlet onto the first reference plane, and wherein at least one of a center of the first inlet projection view and a center of the second inlet projection view is located at a center in a height direction of the first shell body projection.

12. The exhaust apparatus according to claim 8, wherein the muffler main body includes:

a shell body having the muffling chamber therein, the shell body being formed in a cylindrical shape and having a first mouth and a second mouth that is opposite to the first mouth, a side part of the shell body having a main body inlet for supporting the inflow pipe, the shell body defining a second reference plane that is parallel to a longitudinal direction and a height direction of the cylinder, wherein the inflow pipe has an inflow inlet into which exhaust flows, wherein a second shell body projection view is obtained by projecting the shell body onto the second reference plane, wherein a third inlet projection view is obtained by projecting the inflow inlet onto the second reference plane, wherein a fourth inlet projection view is obtained by projecting the main body inlet onto the second reference plane, and wherein at least one of a center of the third inlet projection view and a center of the fourth inlet projection view is located at a center in a height direction of the second shell body projection view.

13. The exhaust apparatus according to claim 1, wherein the outflow pipe has an outflow intermediate part that is adjacent to the second main body wall, and wherein the outflow intermediate part has a second opening that connects a passage of the outflow pipe with the muffling chamber.

14. The exhaust apparatus according to claim 13, wherein the outflow intermediate part of the first muffler includes:

a first portion through which a liquid having flowed into the outflow pipe through the first opening flows;

a second portion that is opposite to the first portion; and a third portion and a fourth portion, each of which connects the first portion to the second portion, wherein at least one of the third portion and the fourth portion has the second opening.

15. The exhaust apparatus according to claim 13, wherein the outflow intermediate part of the first muffler includes:

a first portion through which a liquid having flowed into the outflow pipe through the first opening flows;

a second portion that is opposite to the first portion;

a third portion and a fourth portion, each of which connects the first portion to the second portion, wherein at least one of the second portion, the third portion, and the fourth portion has the second opening.

16. The exhaust apparatus according to claim 13, wherein the outflow intermediate part of the first muffler includes:

a first portion through which a liquid having flowed into the outflow pipe through the first opening flows; and a second portion that is opposite to the first portion, wherein the first portion has a through hole that connects a passage of the outflow intermediate part with the muffling chamber, and wherein only the second portion has the second opening.

17. The exhaust apparatus according to claim 13, wherein the outflow intermediate part of the first muffler includes:

a first portion through which a liquid having flowed into the outflow pipe through the first opening flows; and a second portion that is opposite to the first portion, wherein only the second portion has the second opening.

18. The exhaust apparatus according to claim 1, wherein the outflow pipe has an outflow inlet into which exhaust flows, and wherein the outflow inlet is the first opening.

19. The exhaust apparatus according to claim 1, wherein the muffler main body has a third main body wall and a fourth main body wall, each of which connects the first main body wall to the second main body wall, wherein a forward direction oriented from an upstream to a downstream and a reverse direction opposite to the forward direction are defined with respect to a longitudinal direction of the muffler main body, wherein a width direction is perpendicular to the longitudinal direction and the height direction, wherein the outflow pipe has: an outflow inlet into which exhaust flows; and an outflow outlet from which exhaust outflows, wherein the outflow pipe includes: a first outflow pipe, a second outflow pipe; a third outflow pipe; a fourth outflow pipe; and a fifth outflow pipe that are connected in series;

wherein the first outflow pipe has: a first outflow inlet into which exhaust flows; and a first outflow outlet from which exhaust outflows, the first outflow inlet being the outflow inlet;

wherein the first outflow pipe is adjacent to the first main body wall with respect to the height direction and is adjacent to a center of the muffler main body with respect to the width direction, wherein the second outflow pipe has: a second outflow inlet into which exhaust flows; and a second outflow outlet from which exhaust outflows, the second outflow inlet being connected to the first outflow outlet, wherein, from the second outflow inlet toward the second outflow outlet, the second outflow pipe approaches the second main body wall from the first main body wall with respect to the height direction, and approaches to the third main body wall from a center of the muffler main body with respect to the width direction, wherein the second outflow pipe changes a direction of an exhaust flow from the forward direction to the reverse direction, wherein the third outflow pipe has: a third outflow inlet into which exhaust flows; and a third outflow outlet from which exhaust outflows, the third outflow inlet being connected to the second outflow outlet, wherein the third outflow pipe is located adjacent to the second main body wall with respect to the height direction and is located adjacent to the third main body wall with respect to the width direction, wherein the fourth outflow pipe has: a fourth outflow inlet into which exhaust flows;

and a fourth outflow outlet from which exhaust outflows, the fourth outflow inlet being connected to the third outflow outlet, wherein, from the fourth outflow inlet to the fourth outflow outlet, the fourth outflow pipe approaches a center of the muffler main body from the second main body wall with respect to the height direction and approaches the fourth main body wall from the third main body wall with respect to the width direction, wherein a direction of an exhaust flow of the fourth outflow pipe changes from the reverse direction to the forward direction, wherein the fifth outflow pipe has: a fifth outflow inlet into which exhaust flows; and a fifth outflow outlet from which exhaust outflows, the fifth outflow inlet being connected to the fourth outflow outlet, the fifth outflow outlet being the outflow outlet, and wherein the fifth outflow pipe is located at a center of the muffler main body with respect to the height direction and is located adjacent to the fourth main body wall with respect to the width direction.

20. The exhaust apparatus according to claim 19, wherein the second outflow pipe has a second wall facing part that is adjacent to the second main body wall, wherein the fourth outflow pipe has a fourth wall facing part that is adjacent to the second main body wall, and wherein the second opening is provided in at least one of the second wall facing part, the third outflow pipe, and the fourth wall facing part.

21. The exhaust apparatus according to claim 19, wherein the muffler main body includes:

a shell body having the muffler chamber therein, the shell body being formed in a cylindrical shape and having a first mouth and a second mouth that is opposite to the first mouth;

a first exterior wall for closing the first mouth;

a second exterior wall for closing the second mouth;

a first interior wall, the first interior wall and the first exterior wall defining a first muffling chamber, a second interior wall, the first interior wall and the second interior wall defining a second muffling chamber, the second interior wall and the second exterior wall defining a third muffling chamber, the first muffling chamber, the second muffling chamber, and the third muffling chamber configuring the muffling chamber, the first interior wall having holes that connect the first muffling chamber with the second muffling chamber;

an inner pipe connecting the second muffling chamber with the third muffling chamber; and a valve device for opening and closing the inner pipe, the valve device being open in the case where a pressure of the third muffling chamber is equal to or greater than a threshold value, the valve device being closed in the case where a pressure of the third muffling chamber is smaller than the threshold value, wherein the inflow pipe has a hole that connects a passage of the inflow pipe to the second muffling chamber, wherein the inflow pipe has an inflow outlet from which exhaust outflows, the inflow outlet being located in the third muffling chamber, and wherein the outflow pipe has an outflow inlet into which exhaust flows, the outflow inlet being locating in the first muffling chamber.

22. The exhaust apparatus according to claim 1, wherein the muffler main body has a third main body wall and a fourth main body wall, each of which connects the first main body wall to the second main body wall, wherein the inflow pipe has: an inflow inlet into which exhaust flows; and an inflow outlet from which exhaust outflows, wherein the inflow inlet exists at a center in a height direction of the muffler main body, and wherein the inflow pipe is located adjacent to the third main body wall with respect to a width direction of the muffler main body.

23. The exhaust apparatus according to claim 1, wherein the exhaust pipe includes:

a main pipe oriented to the engine; and a first branch pipe being branched from the main pipe, the first branch pipe being connected to the first muffler, and a second branch pipe being connected to the second muffler.

24. A vehicle comprising the exhaust apparatus according to claim 1.

25. A method for manufacturing an exhaust apparatus, the exhaust apparatus comprising: a first muffler and a second muffler that are arranged in a transverse direction of a vehicle; and an exhaust pipe that causes exhaust of the engine flow into the first muffler and the second muffler, the method comprising:

preparing the first muffler and the second muffler, the first muffler and the second muffler each comprising: a muffler main body having a muffling chamber; an inflow pipe for allowing exhaust of the exhaust pipe to flow into the muffling chamber; and an outflow pipe for discharging exhaust of the muffling chamber to the outside, the muffler main body having a first main body wall and a second main body wall that are opposite to each other in a height direction while the muffling chamber is located therebetween, the outflow pipe having: a first opening that connects a passage in the outflow pipe with the muffling chamber adjacent to the first main body wall; and a second opening that connects a passage in the outflow pipe with the muffling chamber adjacent to the second main body wall;

connecting the first muffler to the exhaust pipe; and connecting the second muffler to the exhaust pipe while vertically inverting the second muffler with respect to the first muffler.

26. The method according to claim 25, further comprising:

locating the first main body wall of the first muffler vertically downwardly of the second main body wall of the first muffler, wherein a liquid staying on the first main body wall of the first muffler can flow into a passage of the outflow pipe through the first opening, locating the second main body wall of the second muffler vertically downwardly of the first main body wall of the second muffler, wherein a liquid staying on the second main body wall of the second muffler can flow into a passage of the outflow pipe through the second opening.

27. A muffler, comprising:

a muffler main body having a muffling chamber;

an inflow pipe for allowing exhaust of an exhaust pipe to flow into the muffling chamber; and an outflow pipe for discharging exhaust of the muffling chamber to the outside, the outflow pipe including a first outflow pipe and a second outflow pipe, wherein the muffler main body has a first main body wall and a second main body wall that are opposite to each other in a height direction while the muffling chamber is located therebetween, wherein the muffling chamber includes a first separator with a first hole and a second hole and a second separator with a first hole and a second hole, wherein the outflow pipe has: a first opening provided in the first outflow pipe that connects a passage of the outflow pipe with the muffling chamber, the first opening being adjacent to the first main body wall; and a second opening provided in the second outflow pipe that connects a passage of the outflow pipe with the muffling chamber, the second opening being adjacent to the second main body wall, and wherein the first hole of the first separator supports a portion of the first outflow pipe between the first opening and an outflow end of the first outflow pipe, the second hole of the first separator supports an outflow end of the second outflow pipe, the first hole of the second separator supports the outflow end of the first outflow pipe, and the second hole of the second separator supports an inflow end of the second outflow pipe.

28. A muffler, comprising:

a muffler main body having a muffling chamber;

an inflow pipe for allowing exhaust of an exhaust pipe to flow into the muffling chamber; and an outflow pipe for discharging exhaust of the muffling chamber to the outside, the outflow pipe including a first outflow pipe and a second outflow pipe, wherein the muffler main body has a first main body wall and a second main body wall that are opposite to each other in a height direction while the muffling chamber is located therebetween, wherein the muffling chamber includes a first separator with a first hole and a second hole and a second separator with a first hole and a second hole, wherein the outflow pipe has: a first opening provided in the first outflow pipe that connects a passage of the outflow pipe with the muffling chamber, the first opening being adjacent to the first main body wall; and a second opening provided in the second outflow pipe that connects a passage of the outflow pipe with the muffling chamber, the second opening being adjacent to the second main body wall, wherein the first hole of the first separator supports a portion of the first outflow pipe between the first opening and an outflow end of the first outflow pipe, the second hole of the first separator supports an outflow end of the second outflow pipe, the first hole of the second separator supports the outflow end of the first outflow pipe, and the second hole of the second separator supports an inflow end of the second outflow pipe, and wherein, in the case where the muffler is set at a reference posture, the first main body wall is located vertically downwardly of the second main body wall, a liquid staying on the first main body wall can flow into a passage of the outflow pipe through the first opening, and wherein, in the case where the muffler is vertically inverted with respect to the reference posture, a liquid staying on the second main body wall can flow into a passage of the outflow pipe through the second opening.

* * * * *